US010696054B2

(12) United States Patent
Shimomura et al.

(10) Patent No.: US 10,696,054 B2
(45) Date of Patent: Jun. 30, 2020

(54) RECORDING APPARATUS, LIQUID STORAGE UNIT, AND MEDIUM ACCOMMODATION UNIT

(71) Applicant: SEIKO EPSON CORPORATION, Tokyo (JP)

(72) Inventors: Masaki Shimomura, Nagano (JP); Koji Shimizu, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/166,212

(22) Filed: Oct. 22, 2018

(65) Prior Publication Data

US 2019/0118542 A1 Apr. 25, 2019

(30) Foreign Application Priority Data

Oct. 24, 2017 (JP) ..... 2017-205345
Jan. 29, 2018 (JP) ..... 2018-012745

(51) Int. Cl.

| | |
|---|---|
| ***B41J 2/175*** | (2006.01) |
| ***B41J 29/13*** | (2006.01) |
| ***B41J 29/38*** | (2006.01) |
| ***B41J 13/10*** | (2006.01) |
| ***B41J 29/02*** | (2006.01) |

(52) U.S. Cl.

CPC ..... *B41J 2/17523* (2013.01); *B41J 2/1752* (2013.01); *B41J 2/17509* (2013.01); *B41J 2/17513* (2013.01); *B41J 13/103* (2013.01); *B41J 29/02* (2013.01); *B41J 29/13* (2013.01); *B41J 29/38* (2013.01); *B41J 2/17553* (2013.01)

(58) Field of Classification Search

CPC .... B41J 2/17523; B41J 29/02; B41J 2/17509; B41J 13/103; B41J 29/38; B41J 29/13; B41J 2/17553; B41J 2/1752; B41J 2/17513

See application file for complete search history.

(56) References Cited

U.S. PATENT DOCUMENTS

2002/0056962 A1* 5/2002 Mori ..... B65H 3/0669 271/242
2007/0296777 A1 12/2007 Hanaoka
(Continued)

FOREIGN PATENT DOCUMENTS

JP 2005-059590 A 3/2005
JP 2007-269041 A 10/2007
JP 2013-212602 A 10/2013
(Continued)

*Primary Examiner* — Yaovi M Ameh
(74) *Attorney, Agent, or Firm* — Global IP Counselors, LLP

(57) ABSTRACT

In a printer, an upstream side transport path for transporting a paper sheet to a recording region in which recording is performed by a recording head from a tube for supplying ink to a recording head from a liquid accommodation body stored in the liquid storage unit and a medium accommodation unit in a state where a recording unit, the liquid storage unit, and a medium accommodation unit are stacked, is configured, and the liquid storage unit includes a liquid storage unit inner transport path including a supply connection section which connects the liquid accommodation body and the tube to each other, and a first transport section which forms a part of the upstream side transport path.

11 Claims, 34 Drawing Sheets

(56) References Cited

U.S. PATENT DOCUMENTS

| | | | | |
|---|---|---|---|---|
| 2015/0210083 | A1 | 7/2015 | Momose | |
| 2016/0221347 | A1 * | 8/2016 | Kanaya | B41J 2/1752 |

FOREIGN PATENT DOCUMENTS

| | | | | | |
|---|---|---|---|---|---|
| JP | 2013212602 | A | * | 10/2013 | B41J 2/1752 |
| JP | 2015-139882 | A | | 8/2015 | |
| WO | 2013/147167 | A2 | | 10/2013 | |

* cited by examiner

RECORDING APPARATUS, LIQUID STORAGE UNIT, AND MEDIUM ACCOMMODATION UNIT

CROSS REFERENCES TO RELATED APPLICATIONS

The entire disclosure of Japanese Patent Application Nos. 2017-205345, filed Oct. 24, 2017 and 2018-012745, filed Jan. 29, 2018 are expressly incorporated by reference herein.

BACKGROUND

1. Technical Field

The present disclosure relates to a recording apparatus that performs recording by ejecting a liquid onto a medium. Further, the disclosure relates to a liquid storage unit and a medium accommodation unit that configure the recording apparatus.

2. Related Art

A recording apparatus represented by an ink jet printer includes: a medium accommodation section which accommodates a medium to which recording is performed therein and is capable of supplying the medium toward a recording head; and a liquid accommodation section which is capable of accommodating the liquid accommodation body, such as a liquid pack into which the liquid to be supplied to the recording head enters.

As such a recording apparatus, for example, JP-A-2015-139882 discloses a recording apparatus including: an apparatus main body including a recording head; and an ink cassette which accommodates an ink pack therein and is inserted into and removed from and attachable to and detachable from a predetermined space provided in the apparatus main body. In the recording apparatus described in JP-A-2015-139882, the ink cassette is set below a paper feed cassette provided in the apparatus main body in order to avoid an increase in an installation area of the apparatus main body.

In such a recording apparatus, there is a demand to configure the paper feed cassette to be additionally installed such that it is possible to accommodate more types or more number of media. However, in the recording apparatus described in JP-A-2015-139882, since the ink cassette is provided below the paper feed cassette of the apparatus main body, in a case where the paper feed cassette is additionally installed further below the ink cassette, it is possible to respond to the above-described request since a path for transporting the medium from the paper feed cassette on the lower side is obstructed by an ink pack disposed in the paper feed cassette, a supply path for supplying the ink, or the like.

In addition, there is a nature that the ink leaks downward as the ink leaks out, and thus, there is also a request to dispose the ink cassette as low as possible.

SUMMARY

An advantage of some aspects of the disclosure is to provide a configuration that takes into account both expandability of an apparatus and appropriate disposition of an ink accommodation section.

According to an aspect of the disclosure, there is provided a recording apparatus, including: a recording unit including a recording section which ejects a liquid onto a medium to perform recording; a liquid storage unit storing a liquid accommodation body which accommodates the liquid to be supplied to the recording section therein; and at least one medium accommodation unit accommodating the medium to be sent to the recording section therein, in which, in a state where the recording unit, the liquid storage unit, and at least one medium accommodation unit are stacked, a supply path for supplying the liquid from the liquid accommodation body stored in the liquid storage unit to the recording section and a transport path for transporting the medium from the medium accommodation unit to a recording region in which recording is performed by the recording section are configured, and in which the liquid storage unit includes a supply connection section which connects the liquid accommodation body and the supply path to each other, and a liquid storage unit inner transport path which forms a part of the transport path and includes a first transport section that transports the medium.

In this case, since the liquid storage unit includes the supply connection section which connects the liquid accommodation body and the supply path to each other, and the liquid storage unit inner transport path which forms a part of the transport path and includes the transport section that transports the medium, it is possible to change disposition of the liquid storage unit with respect to the recording unit or the medium accommodation unit, or to increase the number of medium accommodation units. Above, it is possible to provide a recording apparatus having a configuration that takes into account both expandability of the apparatus and appropriate disposition of the liquid storage unit.

Furthermore, in a case where the recording unit has a tray capable of accommodating the medium built therein, for example, or is configured to be capable of feeding the paper sheet by manual feeding, the recording apparatus can also be configured only by the recording unit and the liquid storage unit.

In the recording apparatus, the liquid storage unit may include a power transmission section which transmits power of a second transport section that is provided in the medium accommodation unit mounted below the liquid storage unit and transports the medium, to the first transport section.

In this case, the first transport section can be driven by using power of the second transport section provided in the medium accommodation unit mounted below the liquid storage unit.

In the recording apparatus, the liquid storage unit may be capable of storing a plurality of the liquid accommodation bodies and may include a first storage section which stores one liquid accommodation body therein, and a second storage section which is provided above the first storage section and stores the remaining liquid accommodation body.

In this case, since the liquid storage unit includes the first storage section and the second storage section disposed in two stages, it is possible to efficiently contain the plurality of the liquid accommodation bodies.

In the recording apparatus, the first storage section and the second storage section may be configured to be drawable to the front of the apparatus, and each of the supply connection sections for the plurality of the liquid accommodation bodies may be disposed on a rear side of the apparatus.

In this case, it is possible to draw out the first storage section and the second storage section to the front part of the apparatus, and to exchange the liquid accommodation body.

In the recording apparatus, the liquid storage unit inner transport path may be provided on the rear side of the apparatus with respect to the supply connection section.

In this case, it is possible to dispose the liquid storage unit inner transport path at a position that does not affect the drawing of the first storage section and the second storage section.

In the recording apparatus, the first storage section and the second storage section may be configured to be drawable to one side of the apparatus, and each of the supply connection sections for the plurality of the liquid accommodation bodies may be disposed on the other side of the apparatus.

In this case, it is possible to draw out the first storage section and the second storage section to one side of the apparatus, and to exchange the liquid accommodation body.

In the recording apparatus, the liquid storage unit inner transport path may be provided on the rear side of the apparatus with respect to the first storage section and the second storage section.

In this case, it is possible to dispose the liquid storage unit inner transport path at a position that does not affect the drawing of the first storage section and the second storage section.

In the recording apparatus, a width of the first storage section may be narrower than a width of the second storage section in a direction intersecting with a drawing-out direction of the first storage section and the second storage section.

In this case, since the width of the first storage section is narrower than the width of the second storage section in the direction intersecting with the drawing-out direction of the first storage section and the second storage section, it is possible to use an empty space below the second storage section, for example, as a space in which other configuration portions are disposed.

In the recording apparatus, at least a part of an upper portion of the liquid storage unit may be formed of sheet metal.

In this case, since the upper portion of the liquid storage unit is formed of sheet metal, the weight of the recording unit or the medium accommodation unit which are attached to the upper side can be received by the sheet metal.

In the recording apparatus, the liquid storage unit may include a first attachment and detachment section which is provided on an upper side thereof and is attachable to and detachable from any one of the recording unit or the medium accommodation unit, and a second attachment and detachment section which is provided on a lower side thereof and is attachable to and detachable from the medium accommodation unit, the first attachment and detachment section may be a positioning projection portion which is formed above the sheet metal and is inserted into a recess portion provided in a bottom portion of the recording unit or the medium accommodation unit, and the second attachment and detachment section may be a positioning recess portion which is an opening formed in the bottom portion of the liquid storage unit and which receives the projection portion provided above the medium accommodation unit.

In this case, a configuration in which another unit is connected to the liquid storage unit can be easily formed.

In the recording apparatus, the recording unit may include a built-in medium accommodation section which is built in the recording unit and accommodates the medium to be sent to the recording section.

In this case, in the recording apparatus including the built-in medium accommodation section as the recording unit, the same operational effect as that of any one of aspects can be obtained.

In the recording apparatus, the liquid storage unit may include a liquid storage unit main body, an inner member which is detachably attached to the liquid storage unit main body and forms a part of the liquid storage unit inner transport path, and an outer member which is configured to be capable of switching between a closed state and an open state with respect to the inner member, forms the liquid storage unit inner transport path together with the inner member in the closed state, and opens the liquid storage unit inner transport path in the open state, the first transport section may include a driving roller provided in the liquid storage unit main body, and a driven roller which is held by the outer member, forms a nipped state with the driving roller in the closed state of the outer member, and releases the nipped state with the driving roller when switching from the closed state to the open state of the outer member, and the driven roller may be detached together with the outer member from the liquid storage unit main body and the driving roller is held by the liquid storage unit main body in a case where the inner member is detached together with the outer member from the liquid storage unit main body.

In this case, in a case where the inner member is detached from the liquid storage unit main body together with the outer member, the driven roller is detached together with the outer member, and the driving roller is held by the liquid storage unit main body. As a result, since it is not necessary to attach and detach the driving roller every time the inner member is attached to and detached from the liquid storage unit main body, it is possible to maintain assembly accuracy of the driving roller with respect to the liquid storage unit main body, and to prevent deterioration of transport accuracy of the medium.

According to another aspect of the disclosure, there is provided a liquid storage unit which is provided below a recording unit including a recording section that ejects a liquid onto a medium and performs recording, and is capable of configuring a recording apparatus, the liquid storage unit including: a storage section which stores a liquid accommodation body in which the liquid to be supplied to the recording section is accommodated; a first attachment and detachment section which is provided on an upper side, and is attachable to and detachable from any one of the recording unit or a medium accommodation unit which accommodates the medium sent to the recording section; a second attachment and detachment section which is provided on a lower side, and is attachable to and detachable from the medium accommodation unit; a supply connection section which connects the liquid accommodation body and a supply path for supplying the liquid from the liquid accommodation body to the recording section to each other, in a state where the recording unit or the medium accommodation unit are mounted in the first attachment and detachment section; and a liquid storage unit inner transport path which forms a part of the transport path for transporting the medium from the medium accommodation unit to a recording region in which recording is performed by the recording section, and includes a transport section which transports the medium, in a state where the medium accommodation unit is mounted in the second attachment and detachment section.

In this case, it is possible to form the recording apparatus in which the liquid storage unit is disposed below the recording unit. Since the liquid storage unit is disposed below the recording unit, for example, even when the liquid leaks inadvertently from the liquid storage unit, it is possible to reduce a concern that the leaking liquid adheres to the recording unit.

In addition, since the liquid storage unit includes the second attachment and detachment section and the liquid storage unit inner transport path, it is possible to mount the medium accommodation unit below the liquid storage unit, that is, it is possible to improve expandability of the recording apparatus.

In the liquid storage unit, a liquid storage unit main body; an inner member which is detachably attached to the liquid storage unit main body and forms a part of the liquid storage unit inner transport path; and an outer member which is configured to be capable of switching between a closed state and an open state with respect to the inner member, forms the liquid storage unit inner transport path together with the inner member in the closed state, and opens the liquid storage unit inner transport path in the open state, may further be provided, the transport section may include a driving roller provided in the liquid storage unit main body, and a driven roller which is held by the outer member, in which a nipped state with the driving roller is formed in the closed state of the outer member, and in which a nipped state with the driving roller is released when switching from the closed state to the open state of the outer member, and the driven roller may be detached together with the outer member and the driving roller may be held by the liquid storage unit main body in a case where the inner member is detached from the liquid storage unit main body together with the outer member.

In this case, in a case where the inner member is detached from the liquid storage unit main body together with the outer member, the driven roller is detached together with the outer member, and the driving roller is held by the liquid storage unit main body. As a result, since it is not necessary to attach and detach the driving roller every time the inner member is attached to and detached from the liquid storage unit main body, it is possible to maintain assembly accuracy of the driving roller with respect to the liquid storage unit main body, and to prevent deterioration of transport accuracy of the medium.

According to still another aspect, there is provided a recording apparatus, including: a recording unit including a recording section which ejects a liquid onto a medium to perform recording; a liquid storage unit storing a liquid accommodation body which accommodates the liquid to be supplied to the recording section therein; and at least one medium accommodation unit accommodating the medium to be sent to the recording section therein, in which, in a state where the recording unit, the liquid storage unit, and at least one medium accommodation unit are stacked, a supply path for supplying the liquid from the liquid accommodation body stored in the liquid storage unit to the recording section and a transport path for transporting the medium from the medium accommodation unit to a recording region in which recording is performed by the recording section are configured, and in which the medium accommodation unit includes a medium accommodation section which accommodates the medium therein, a feeding section which sends out the medium from the medium accommodation section to the transport path, and a passage section through which a part of the supply path passes.

In this case, since the supply path can be formed even when the number of the medium accommodation units increases, it is possible to improve expandability of the apparatus. In addition, the liquid storage unit is positioned below the recording unit and the medium accommodation unit. Above, it is possible to provide a recording apparatus having a configuration that takes into account both expandability of the apparatus and appropriate disposition of the liquid storage unit.

In the recording apparatus, the supply path may be formed by a tube through which the liquid flows, and the passage section may be a space through which the tube passes.

In this case, it is possible to easily realize a configuration of sending the liquid from the liquid storage unit to the recording unit via the medium accommodation unit.

In the recording apparatus, the passage section may include a relay path which is the supply path that relays a first supply path that serves as the supply path provided on the recording unit side and a second supply path that serves as the supply path provided on the liquid storage unit side.

In this case, it is possible to easily realize a configuration of sending the liquid from the liquid storage unit to the recording unit via the medium accommodation unit.

According to still another aspect of the disclosure, there is provided a medium accommodation unit including: an upper attachment and detachment section which is capable of configuring a recording apparatus being stacked together with a liquid storage unit which stores the liquid accommodation body that accommodates the liquid to be supplied to a recording section therein on a lower side of a recording unit including the recording section which ejects a liquid onto a medium and performs recording, is provided on an upper side, and is attachable to and detachable from the recording unit; a lower attachment and detachment section which is provided on a lower side, and is attachable to and detachable from the liquid storage unit; a medium accommodation section which accommodates the medium therein; a feeding section which sends out the medium to a transport path for transporting the medium to a recording region in which recording is performed by the recording section, from the medium accommodation section in a state where the recording unit is mounted in the upper attachment and detachment section and the liquid storage unit is mounted in the lower attachment and detachment section; and a passage section through which a part of a supply path for supplying the liquid to the recording section can pass from the liquid accommodation body stored in the liquid storage unit.

In this case, since the supply path can be formed even when the number of the medium accommodation units increases, it is possible to improve expandability of the recording apparatus. In addition, the liquid storage unit is positioned below the recording unit and the medium accommodation unit. Above, it is possible to obtain a configuration that takes into account both expandability of the recording apparatus and appropriate disposition of the liquid storage unit.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

First Embodiment

A recording apparatus according to an embodiment of the disclosure will be described. As an example of a recording apparatus, an ink jet printer 1 (hereinafter, simply referred to as a printer 1) is taken as an example.

Figure 1:
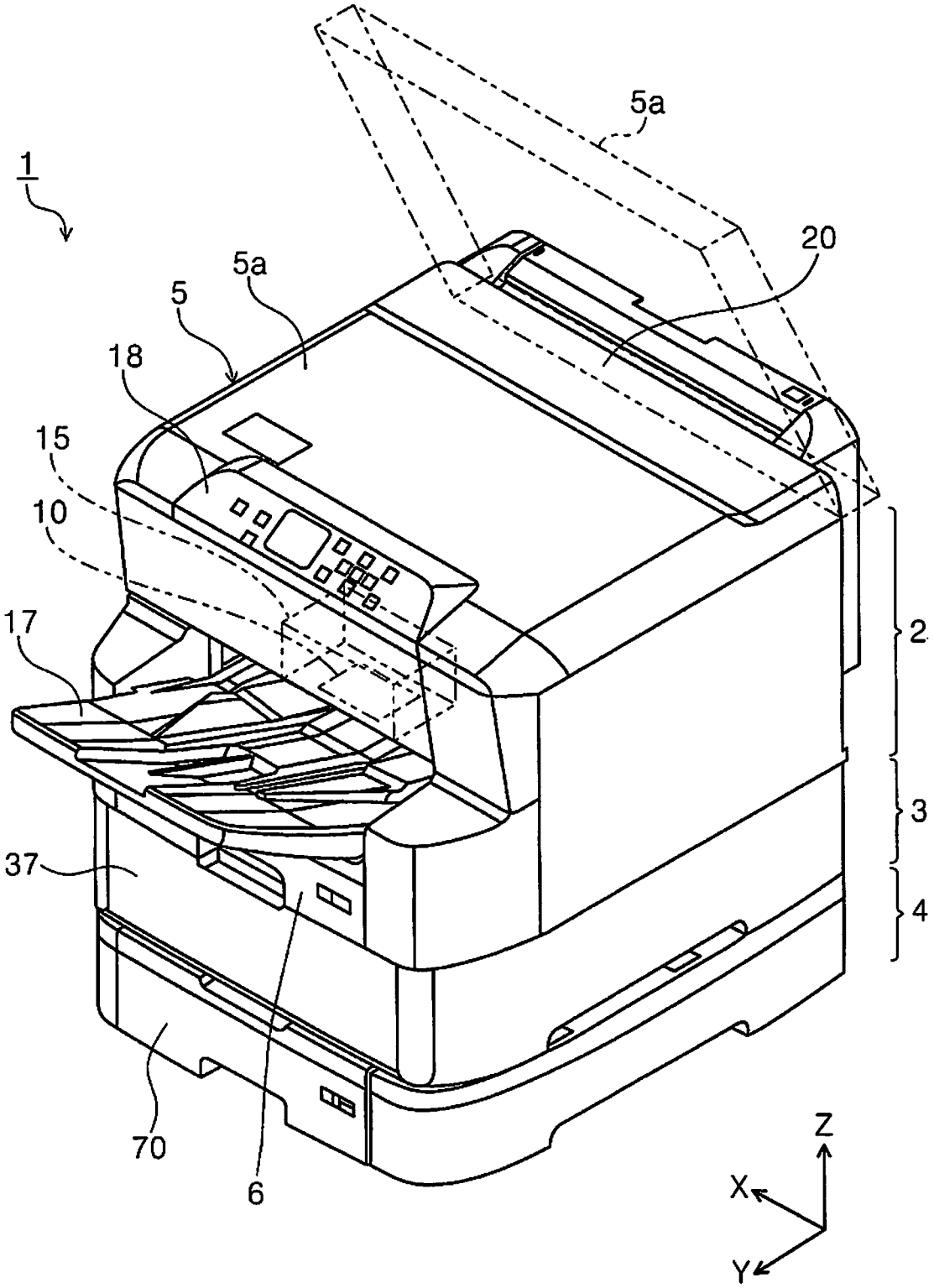
FIG. 1 is an external perspective view of a printer according to a first embodiment.
Figure 2:
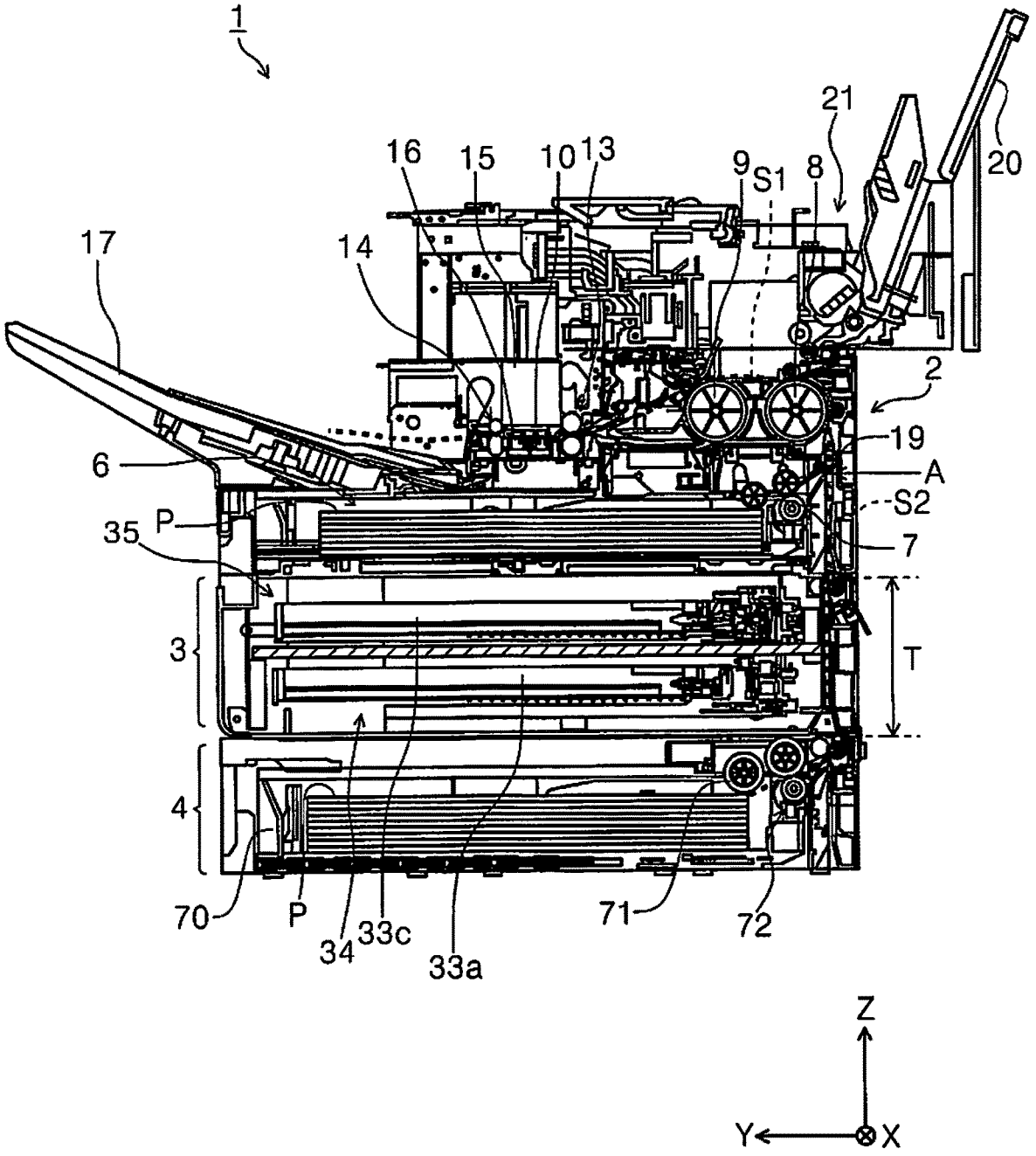
FIG. 2 is a side sectional view of the printer according to the first embodiment.
Figure 3:
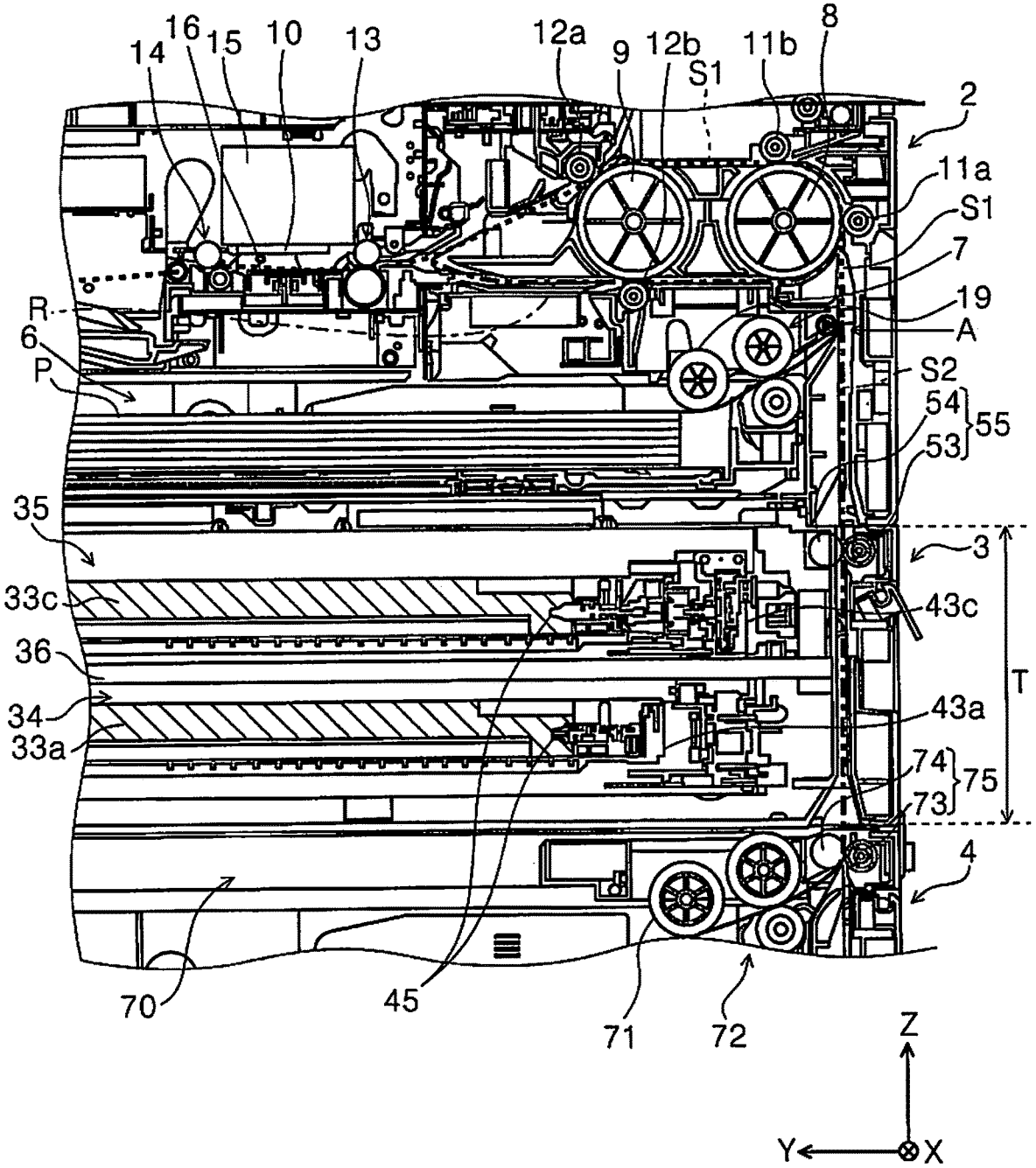
FIG. 3 is an enlarged view of a main portion of FIG. 2.
Figure 4:
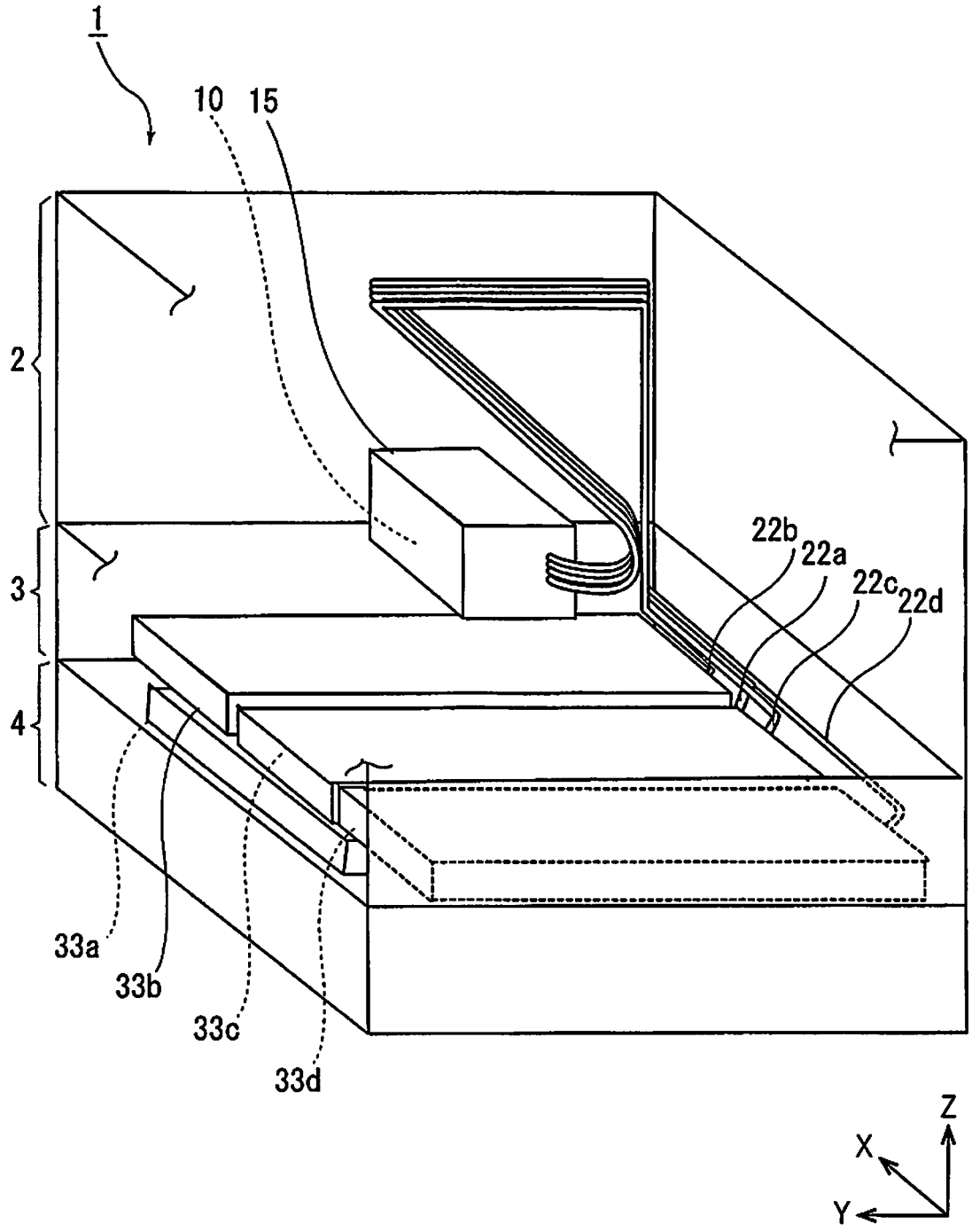
FIG. 4 is a schematic view of the printer according to the first embodiment.
Figure 5:
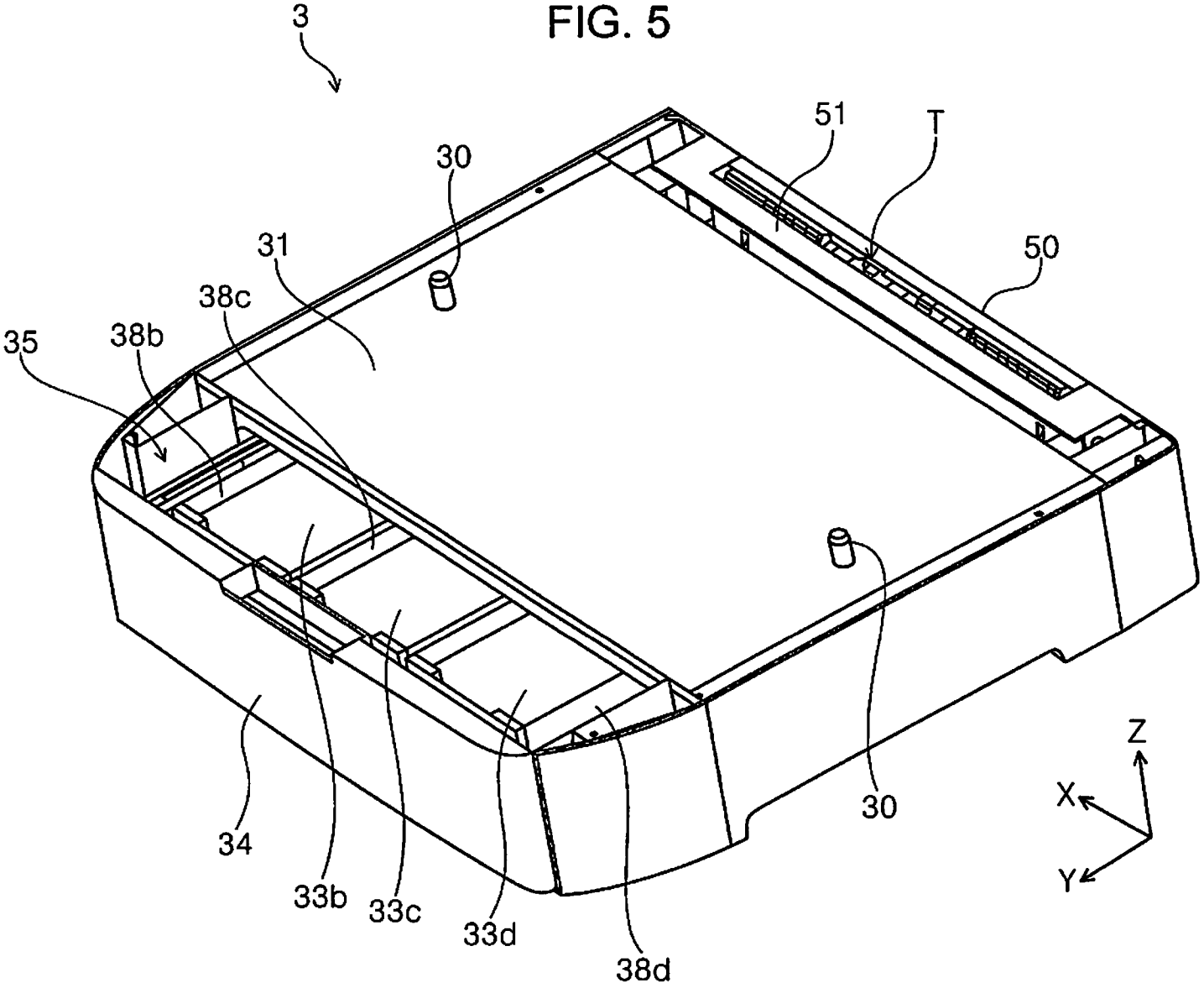
FIG. 5 is a perspective view of a liquid storage unit.
Figure 6:
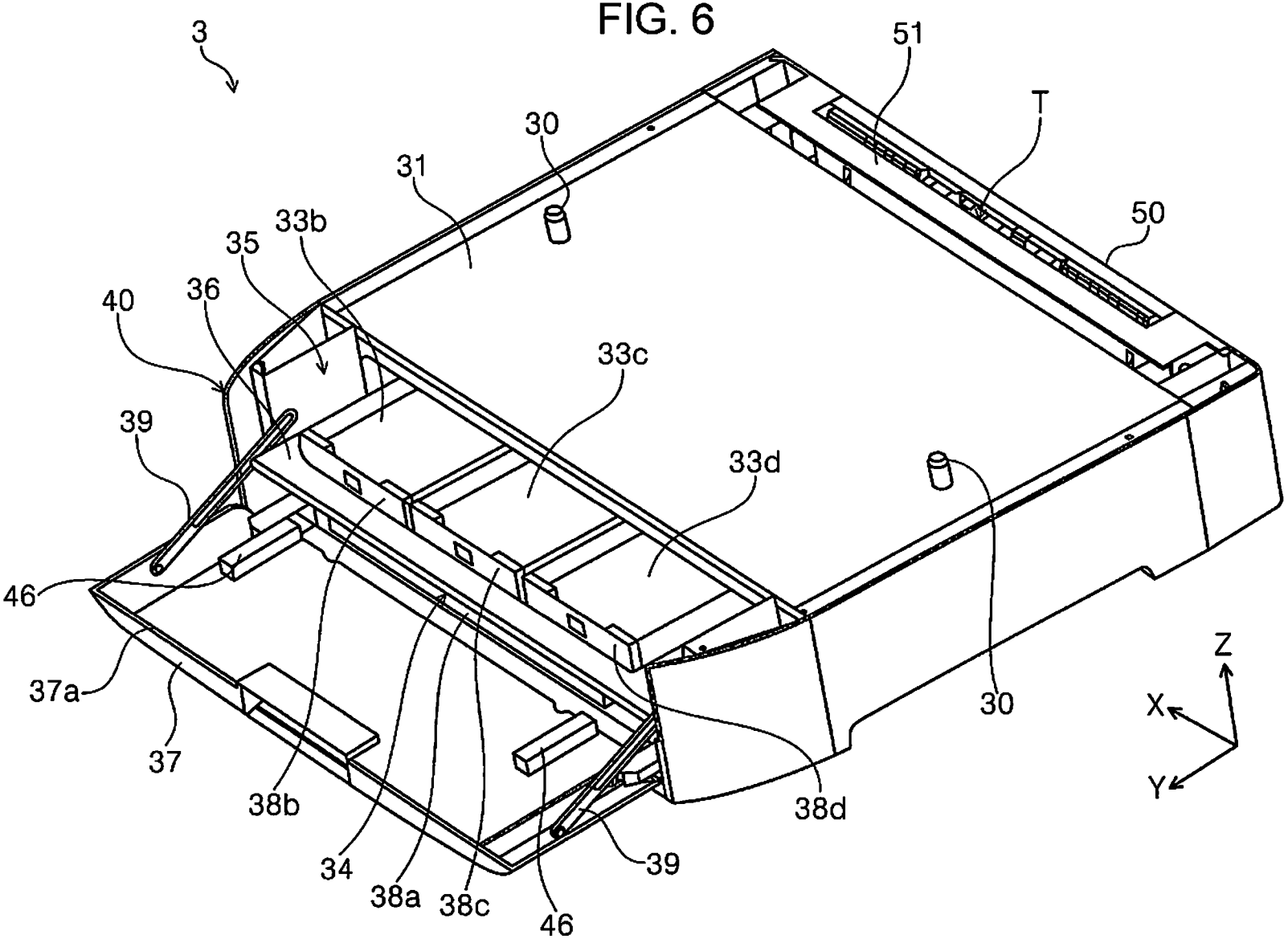
FIG. 6 is a perspective view illustrating a state where an opening/closing cover of the liquid storage unit is open.
Figure 7:
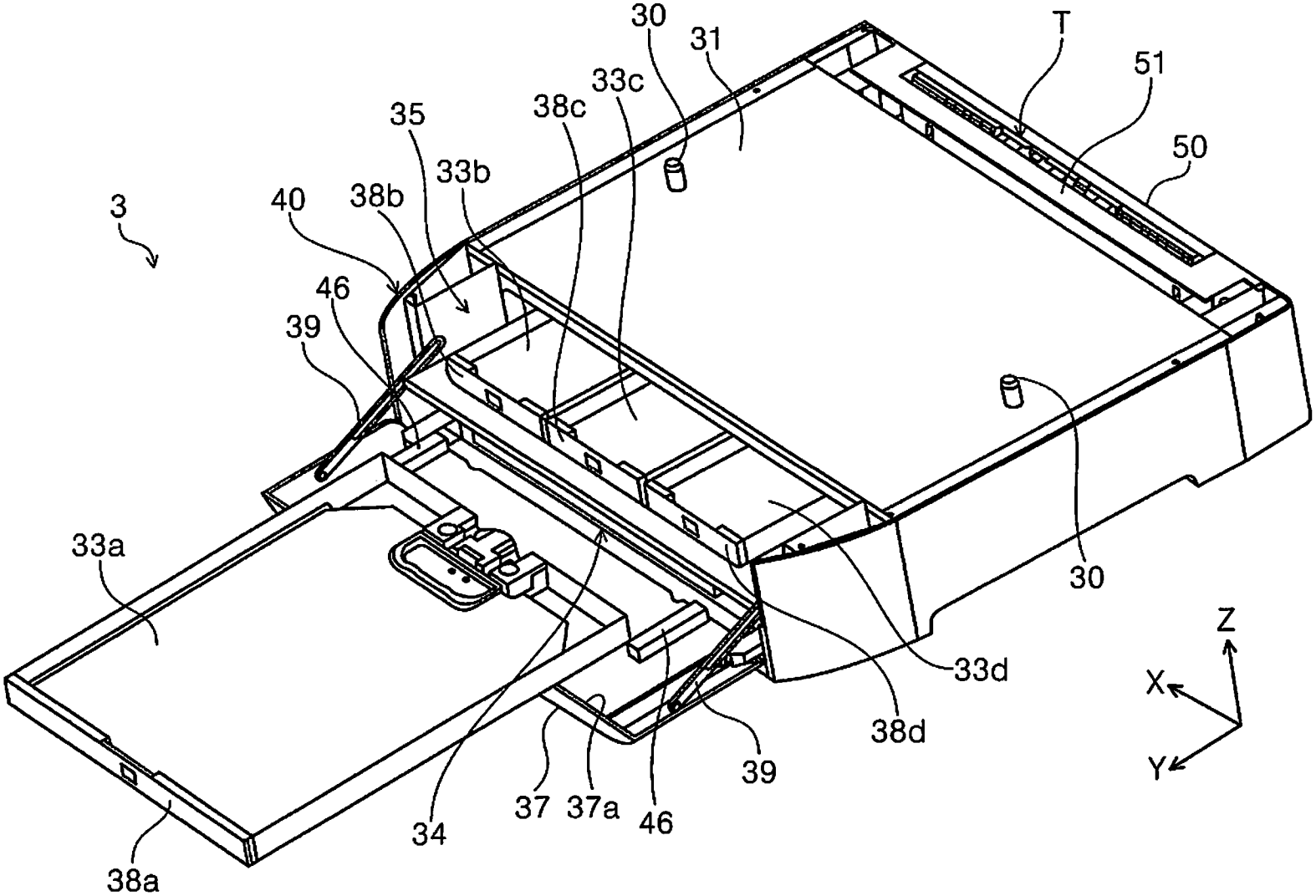
FIG. 7 is a perspective view illustrating a state where a drawable tray of a first storage section is drawn out from the liquid storage unit.
Figure 8:
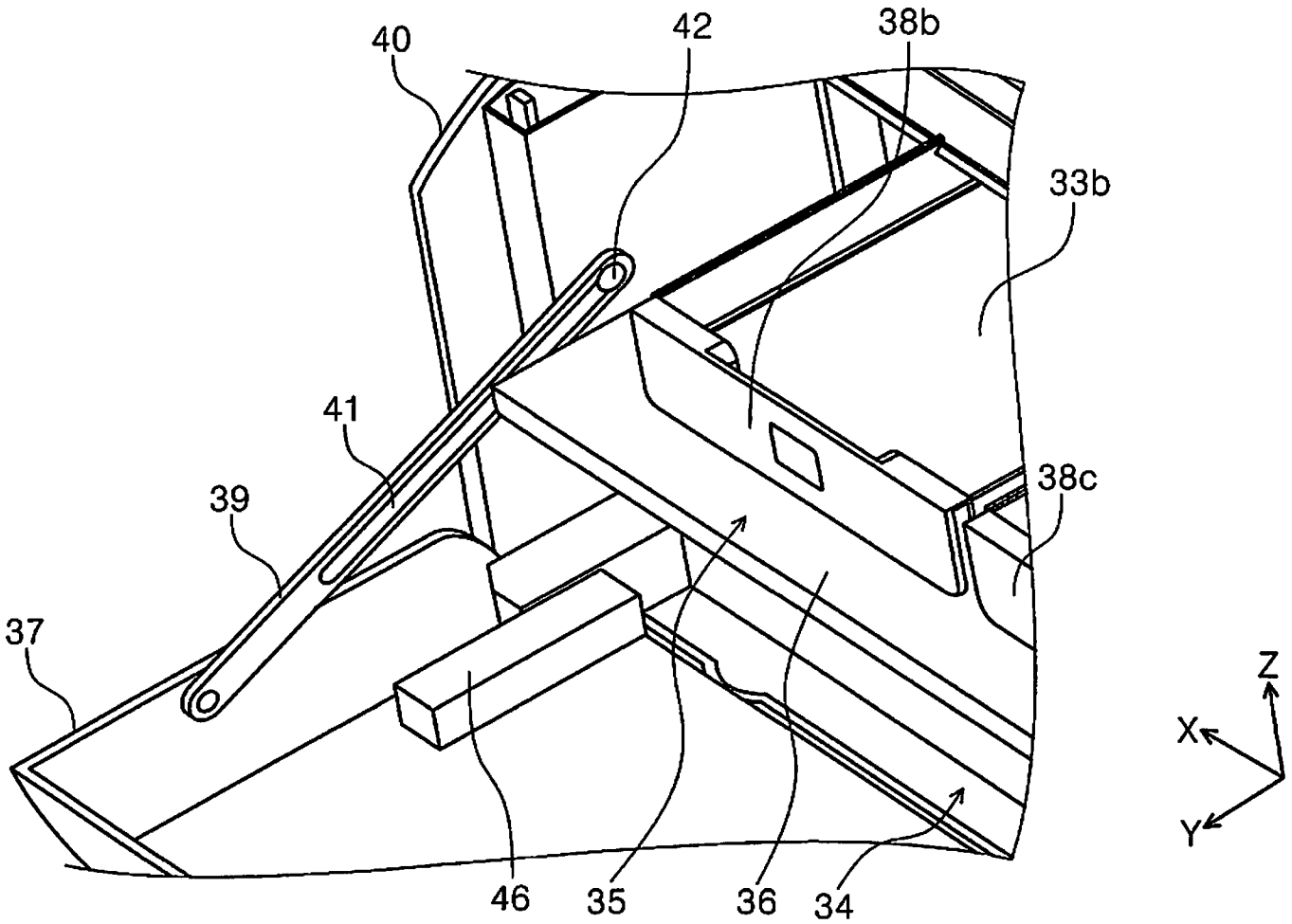
FIG. 8 is an enlarged view of a main portion of FIG. 6.

FIG. 1 is an external perspective view of the printer according to a first embodiment. FIG. 2 is a side sectional view of the printer according to the first embodiment. FIG. 3 is an enlarged view of a main portion of FIG. 2. FIG. 4 is a schematic view of the printer according to the first embodiment. FIG. 5 is a perspective view of a liquid storage unit. FIG. 6 is a perspective view illustrating a state where an opening/closing cover of the liquid storage unit is open. FIG. 7 is a perspective view illustrating a state where a drawable tray of a first storage section is drawn out from the liquid storage unit. FIG. 8 is an enlarged view of a main portion of FIG. 6.

Figure 9:
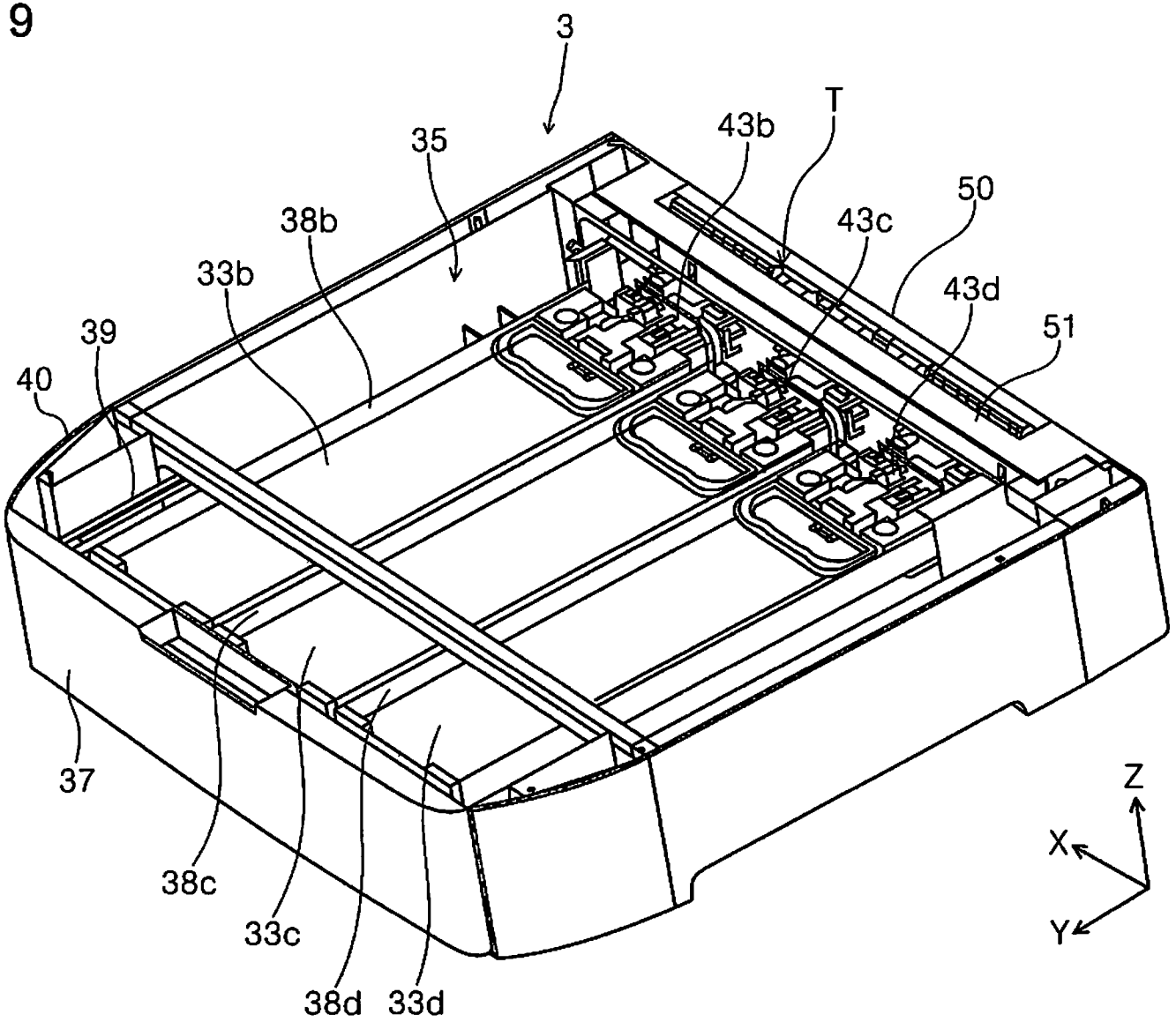
FIG. 9 is a perspective view illustrating a state where an upper surface portion is removed from the liquid storage unit.
Figure 10:
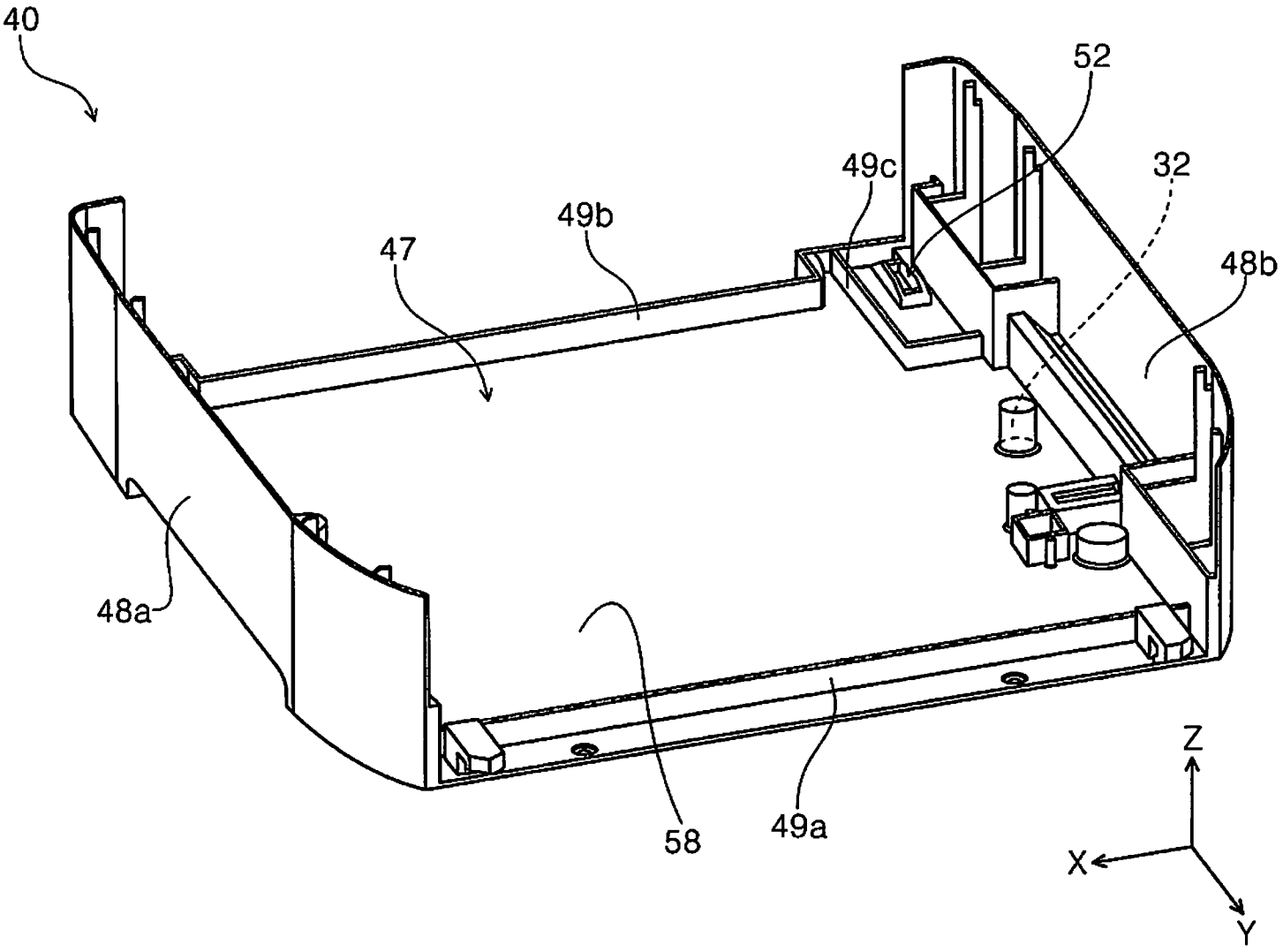
FIG. 10 is a perspective view illustrating a housing of the liquid storage unit.
Figure 11:
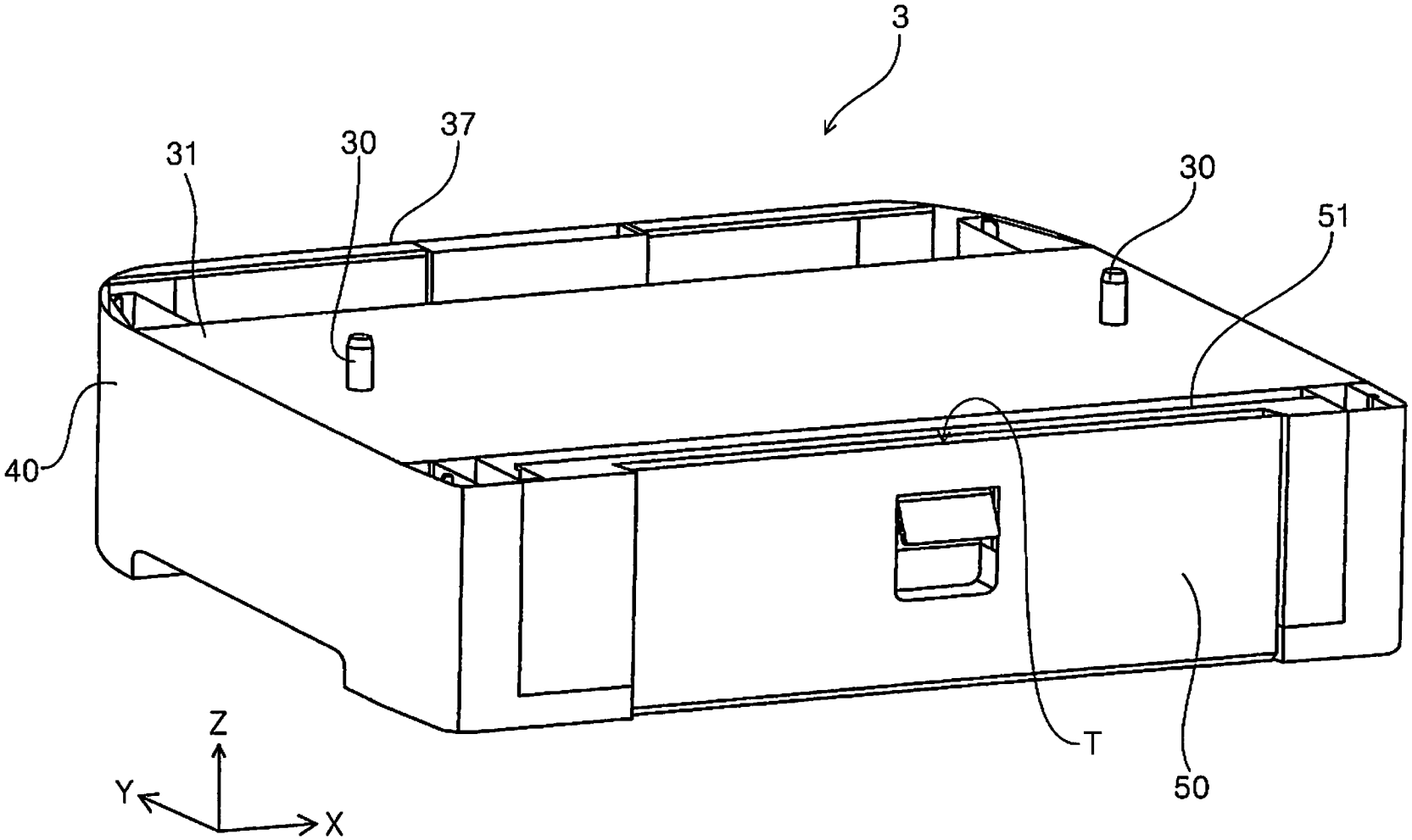
FIG. 11 is a perspective view when the liquid storage unit is viewed from the rear side of the apparatus.
Figure 12:
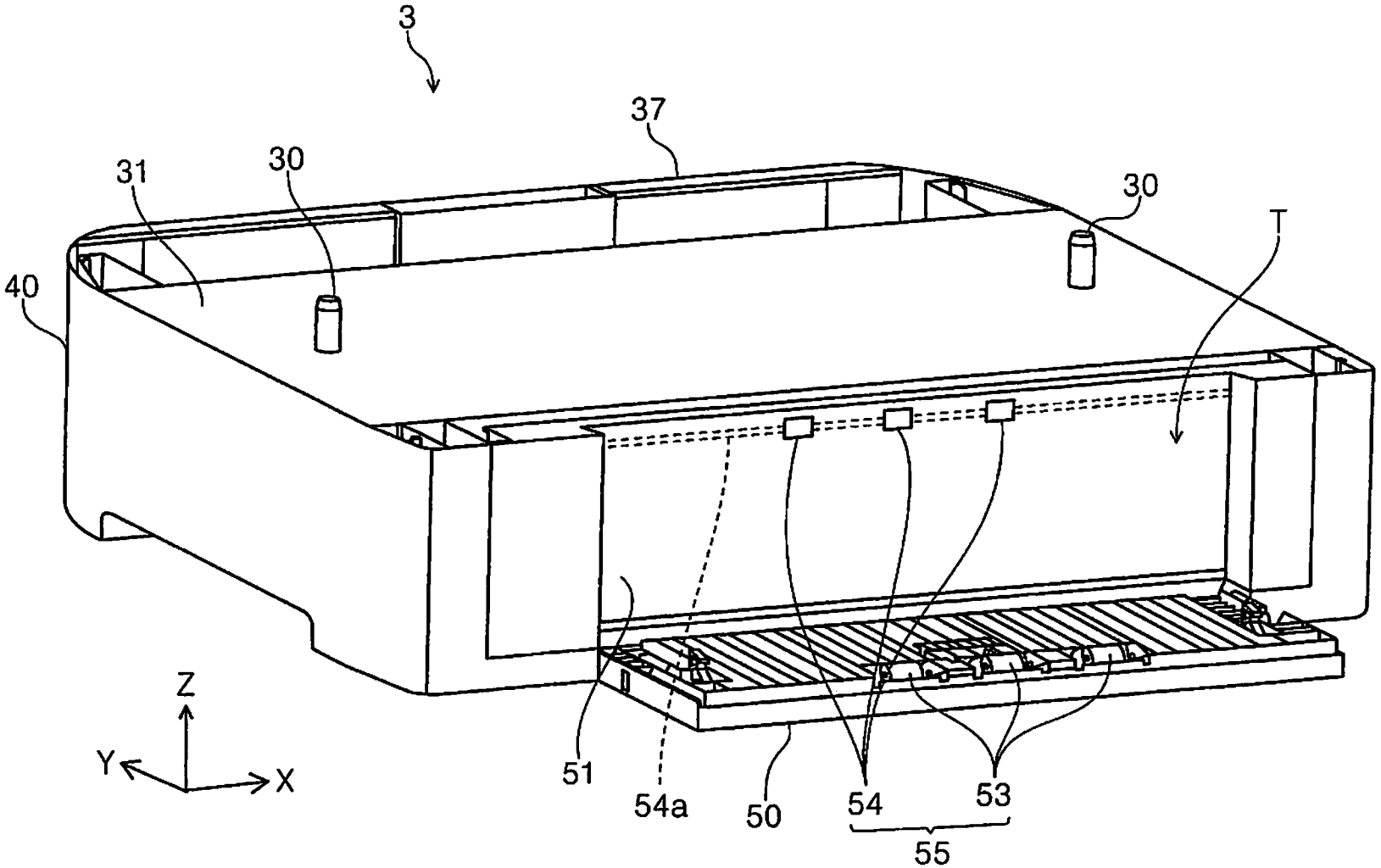
FIG. 12 is a perspective view illustrating a state where a back surface cover of the liquid storage unit is open.
Figure 13:
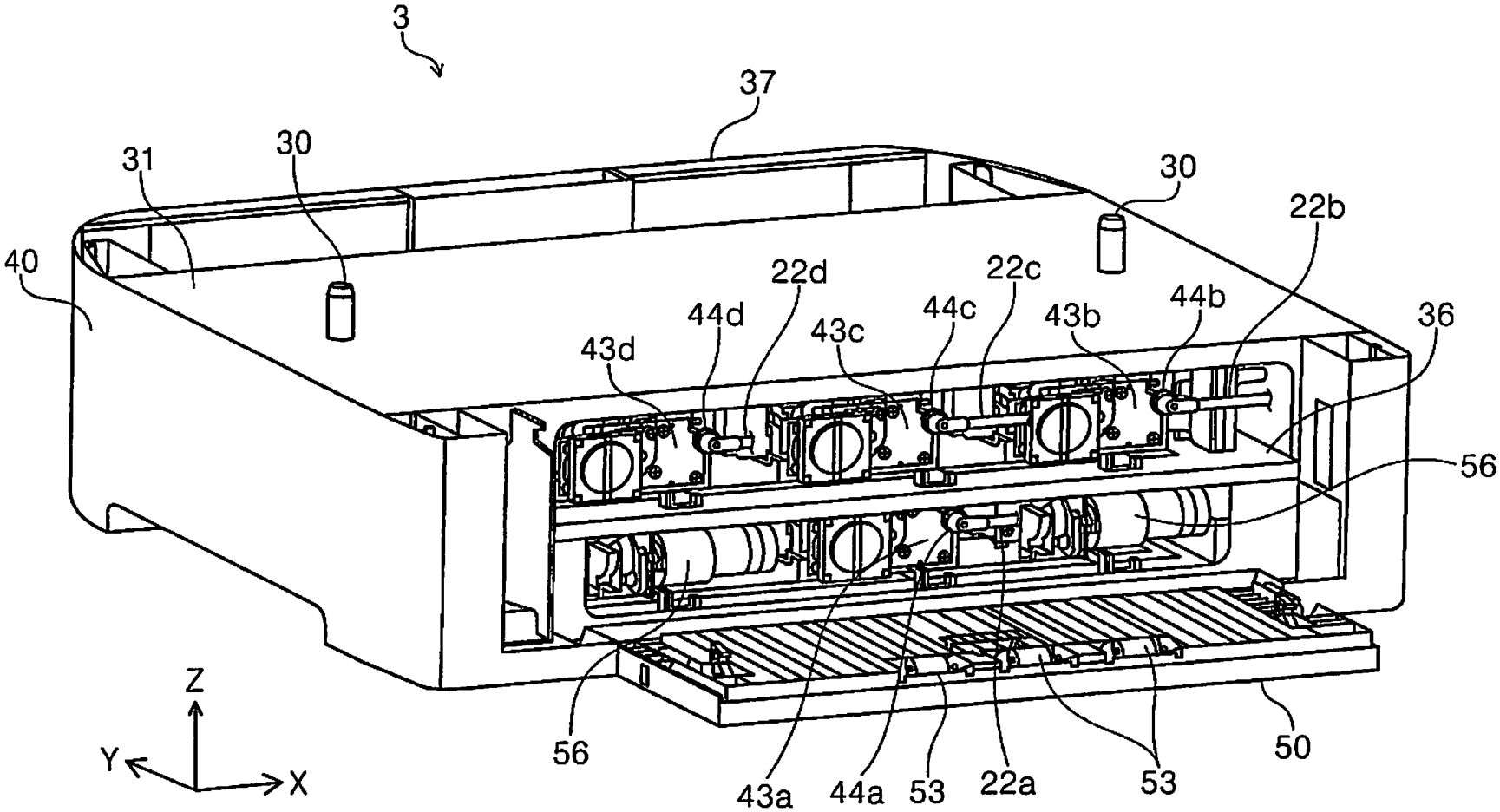
FIG. 13 is a perspective view illustrating a state where an inner cover is detached from the liquid storage unit of which the back surface cover is open.
Figure 14:
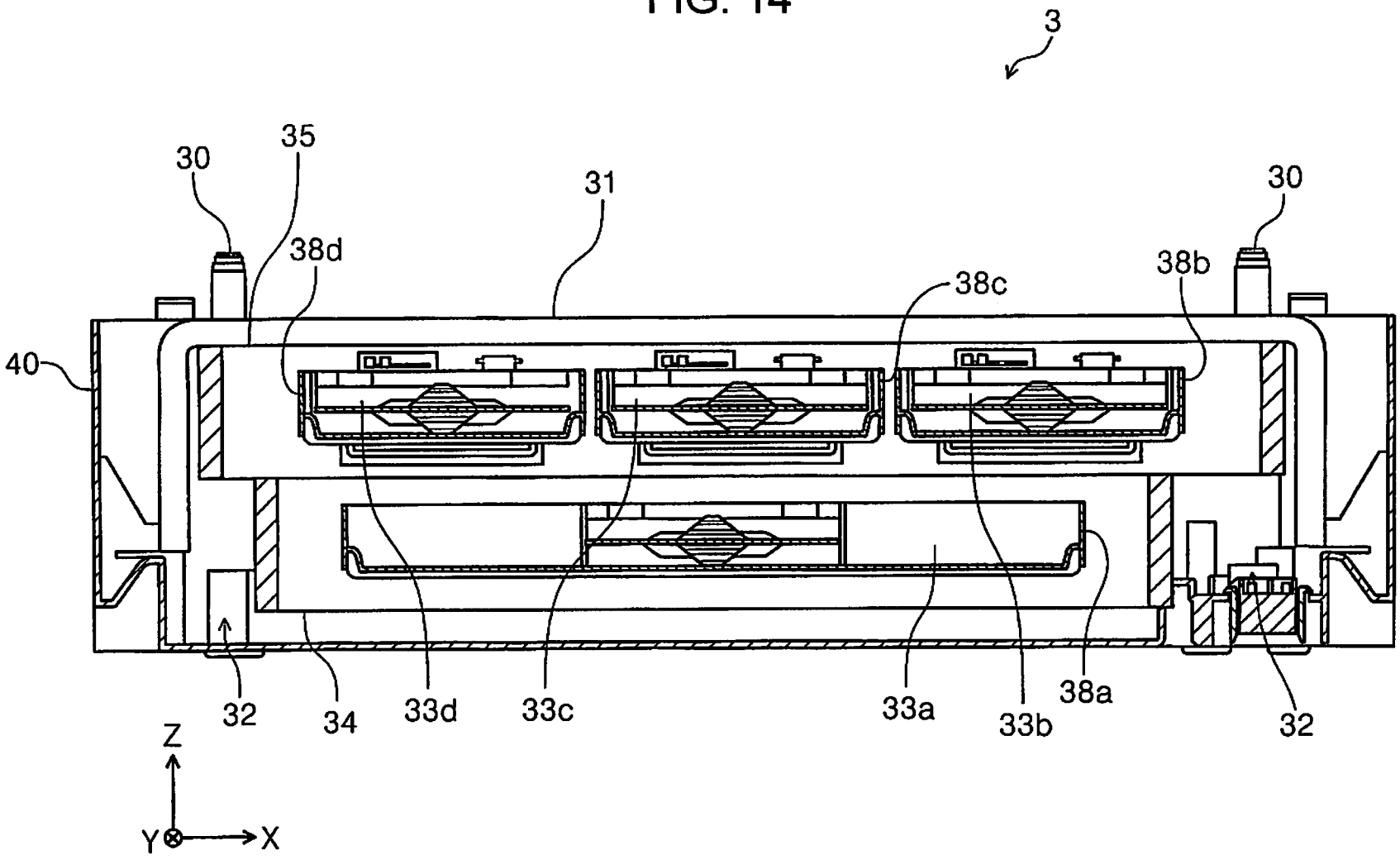
FIG. 14 is a sectional view of a Z-X plane of the liquid storage unit.
Figure 15:
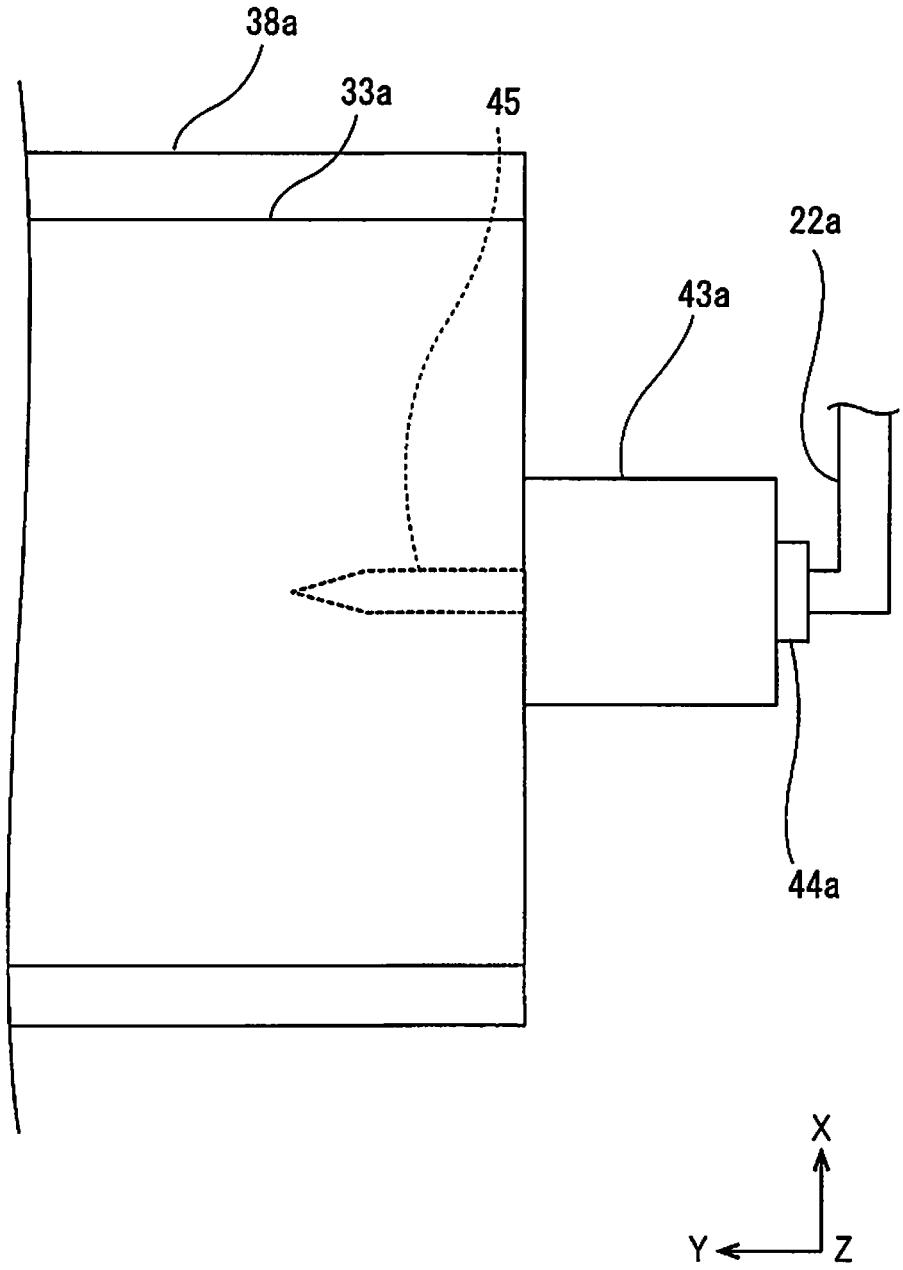
FIG. 15 is a schematic view of a supply connection section.
Figure 16:
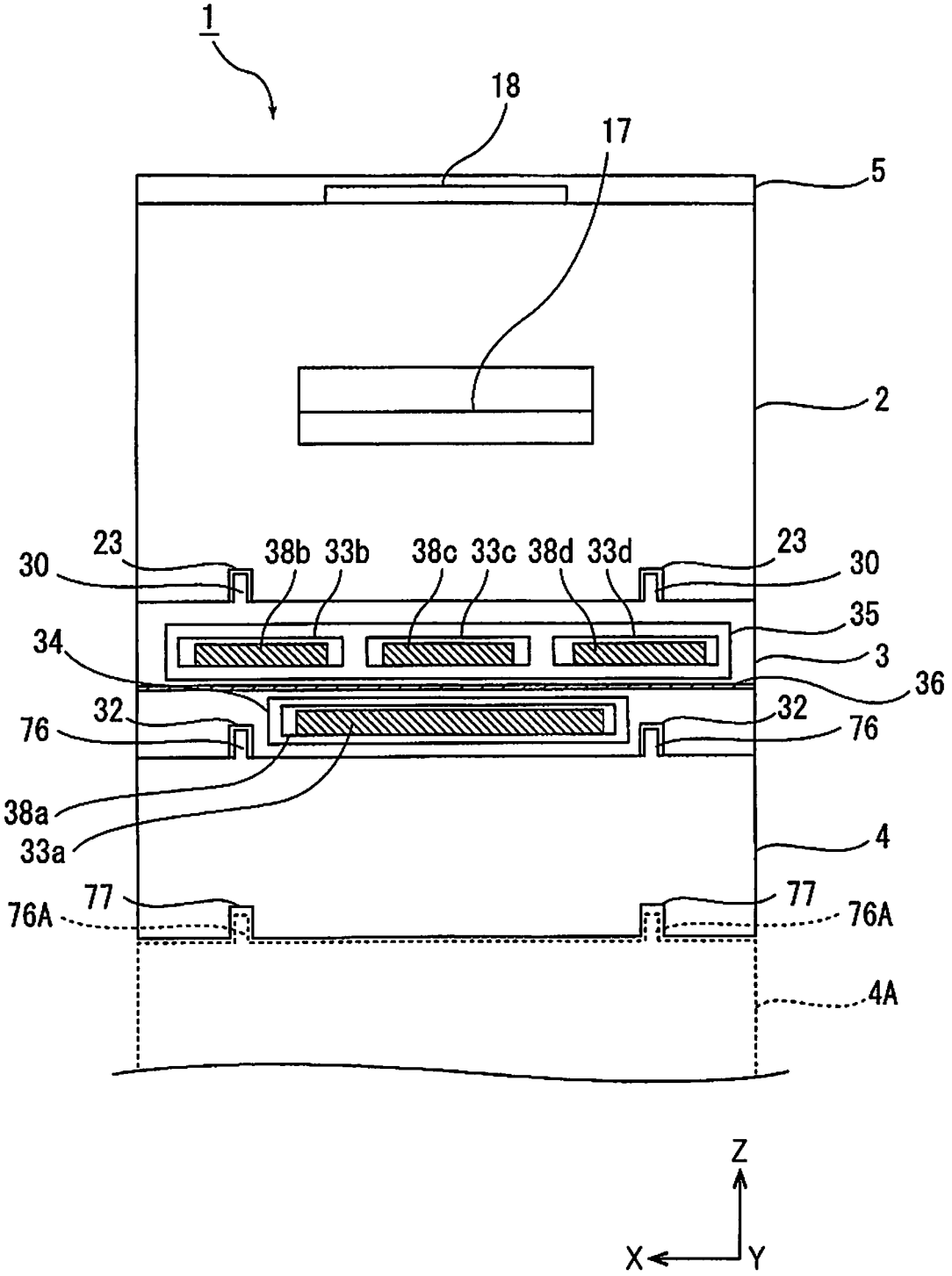
FIG. 16 is a schematic view of the printer according to the first embodiment.
Figure 17:
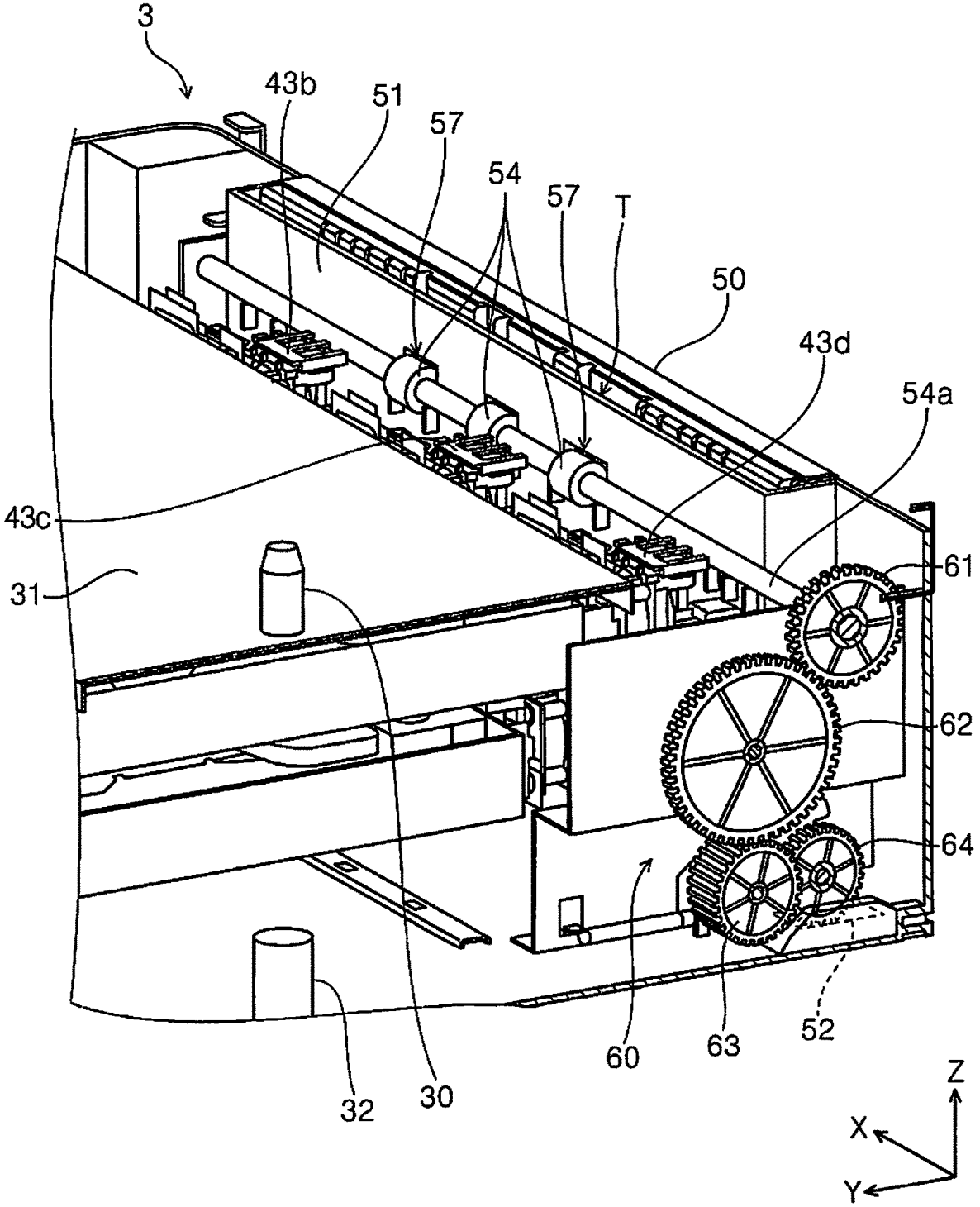
FIG. 17 is a perspective view illustrating a first transport path and a power transmission section to a first driving roller provided in the first transport path.
Figure 18:
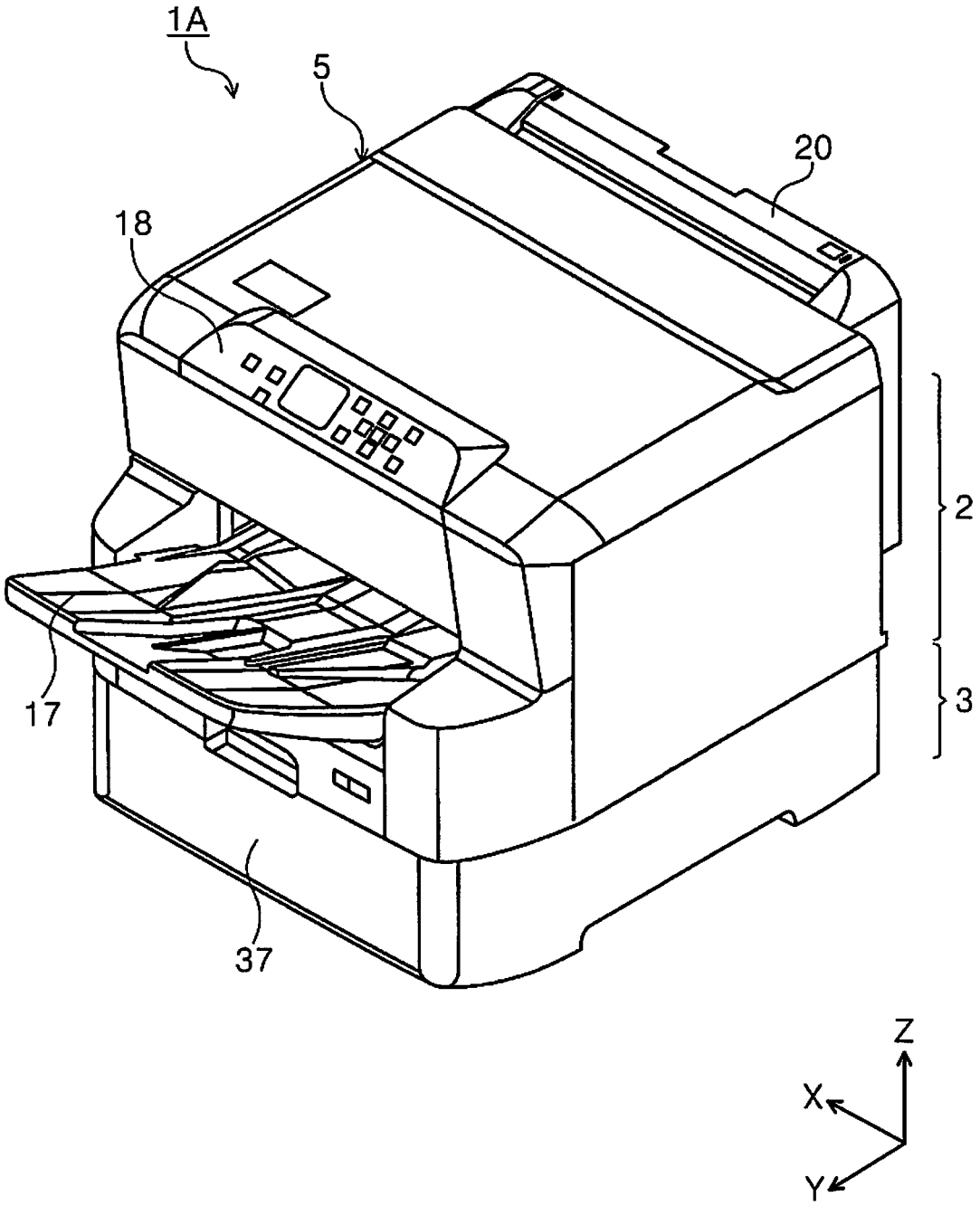
FIG. 18 is a perspective view illustrating another example of the printer according to the first embodiment.

FIG. 9 is a perspective view illustrating a state where an upper surface portion is removed from the liquid storage unit. FIG. 10 is a perspective view illustrating a housing of the liquid storage unit. FIG. 11 is a perspective view when the liquid storage unit is viewed from the rear side of the apparatus. FIG. 12 is a perspective view illustrating a state where a back surface cover of the liquid storage unit is open. FIG. 13 is a perspective view illustrating a state where an inner cover is detached from the liquid storage unit of which the back surface cover is open. FIG. 14 is a sectional view of a Z-X plane of the liquid storage unit. FIG. 15 is a schematic view of a supply connection section. FIG. 16 is a schematic view of the printer according to the first embodiment. FIG. 17 is a perspective view illustrating a first transport path and a power transmission section to a first driving roller provided in the first transport path. FIG. 18 is a perspective view illustrating another example of the printer according to the first embodiment.

Figure 26:
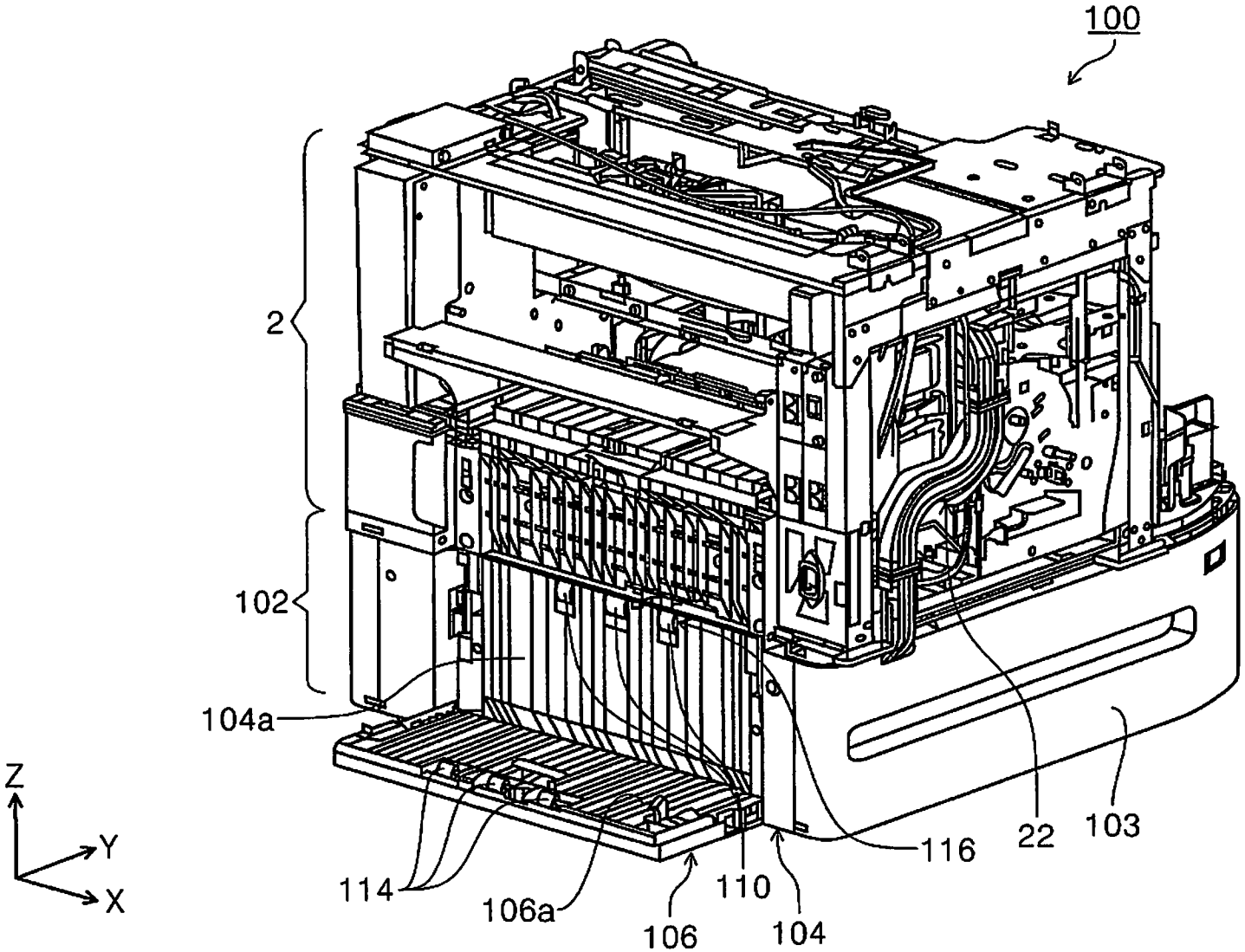
FIG. 26 is a rear perspective view of a printer according to a modification form of the first embodiment.
Figure 27:
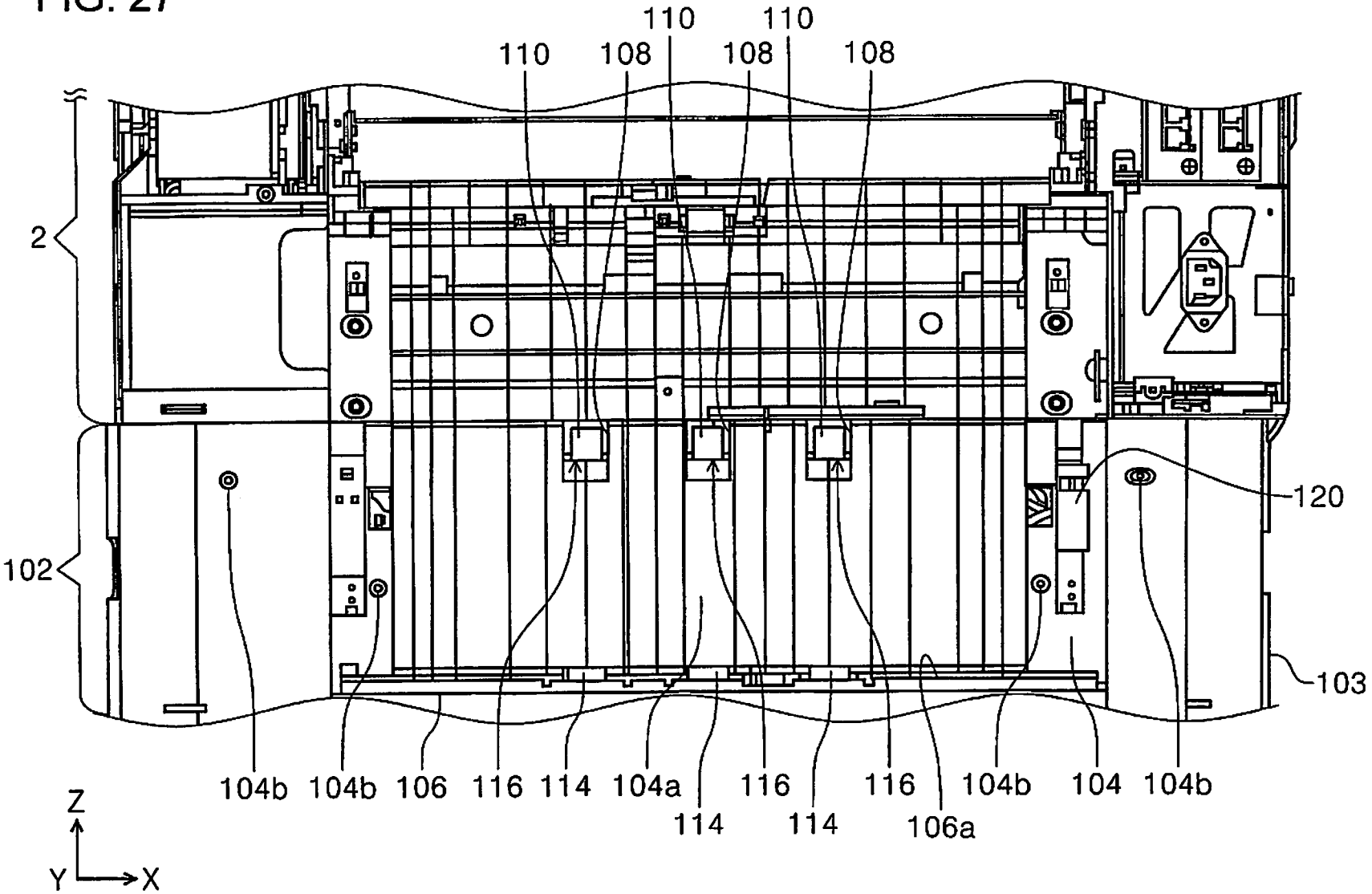
FIG. 27 is a rear view illustrating a state where a back surface cover of a liquid storage unit according to a modification form of the first embodiment is open.
Figure 28:
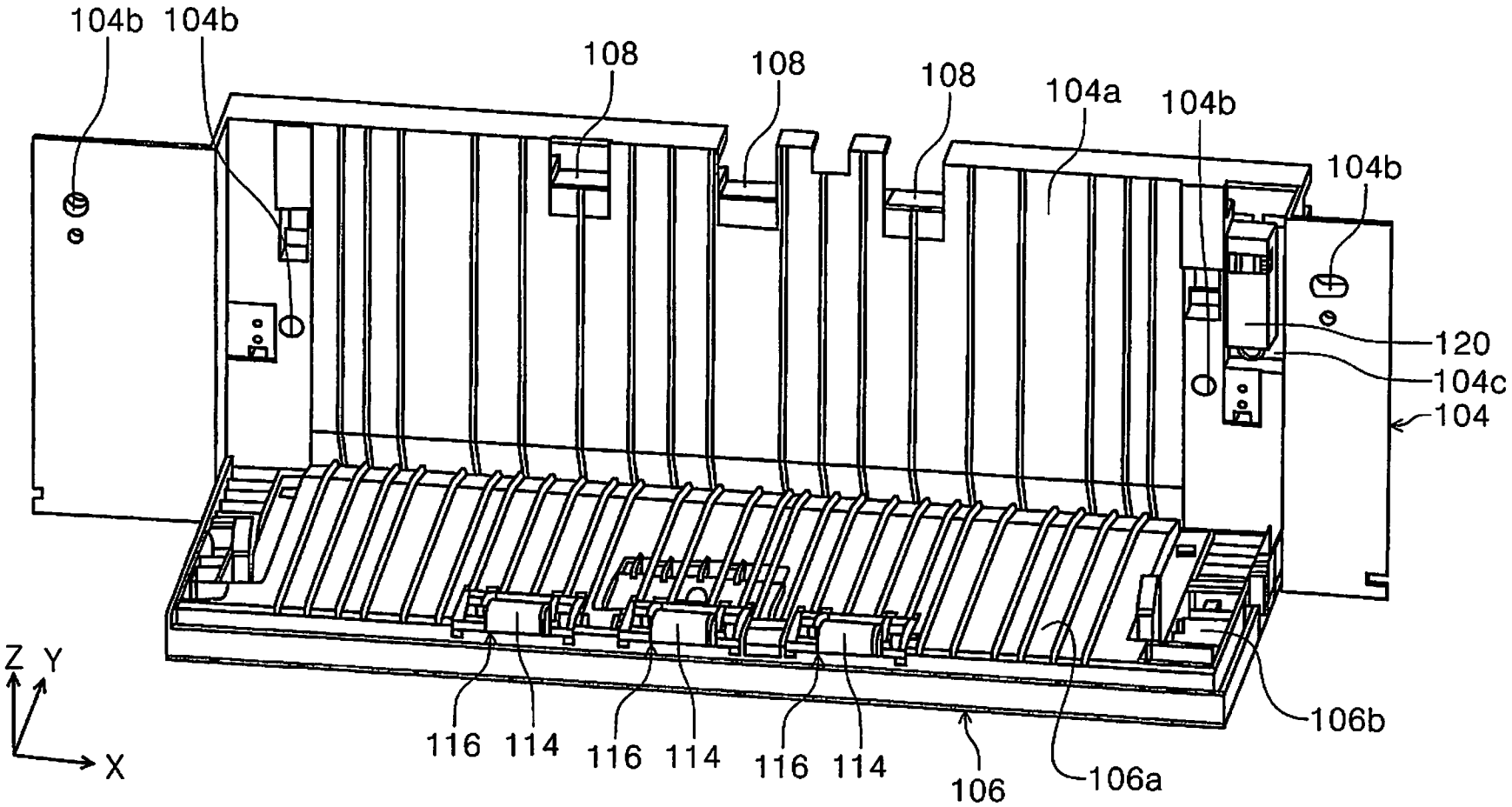
FIG. 28 is a perspective view of an inner cover and a back surface cover according to a modification form of the first embodiment.
Figure 29:
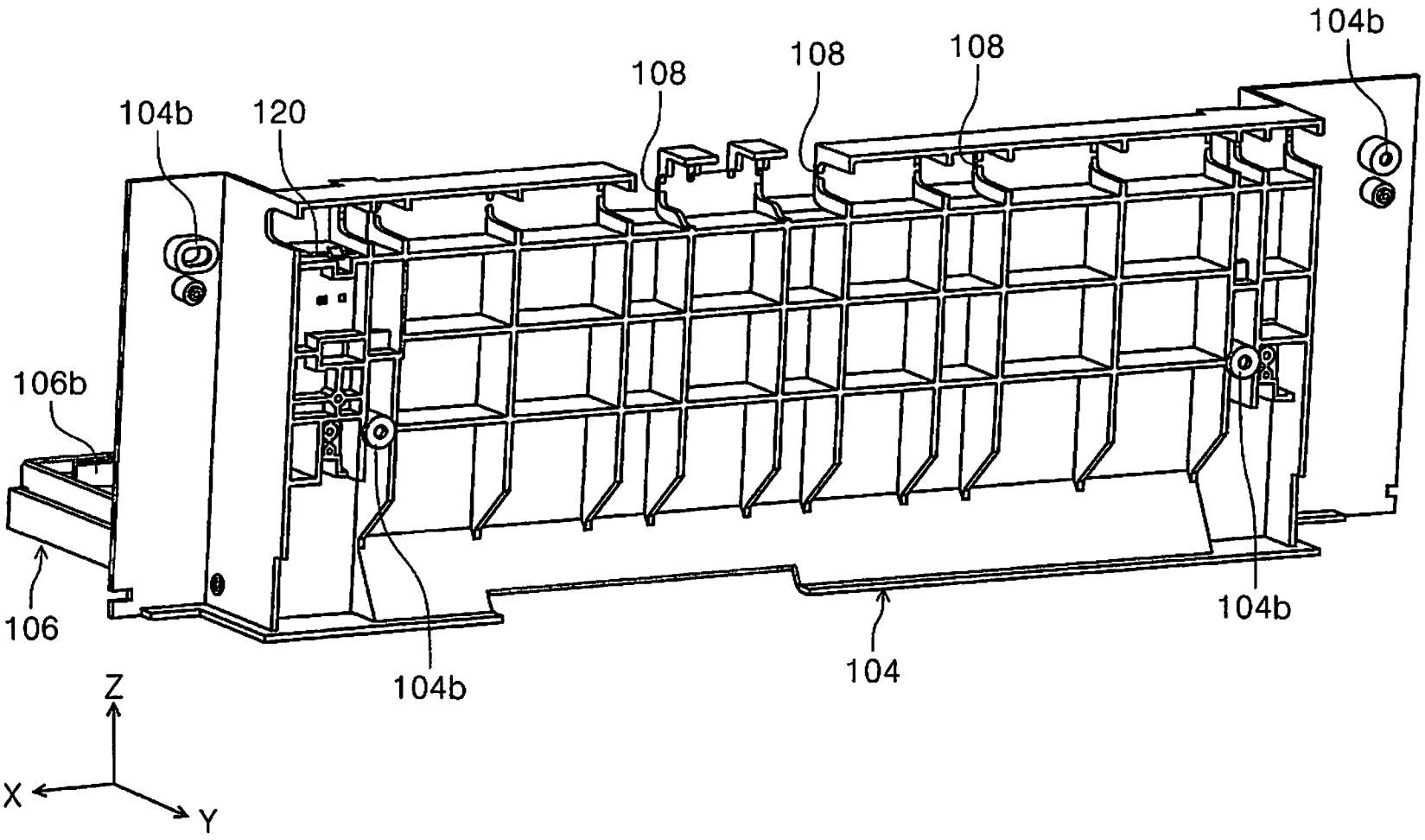
FIG. 29 is a perspective view of an inner cover according to a modification form of the first embodiment.

FIG. 26 is a rear perspective view of a printer according to a modification form of the first embodiment, FIG. 27 is a rear view illustrating a state where a back surface cover of a liquid storage unit according to a modification form of the first embodiment is open, FIG. 28 is a perspective view of an inner cover and a back surface cover according to a modification form of the first embodiment, and FIG. 29 is a perspective view of an inner cover according to a modification form of the first embodiment.

Figure 30:
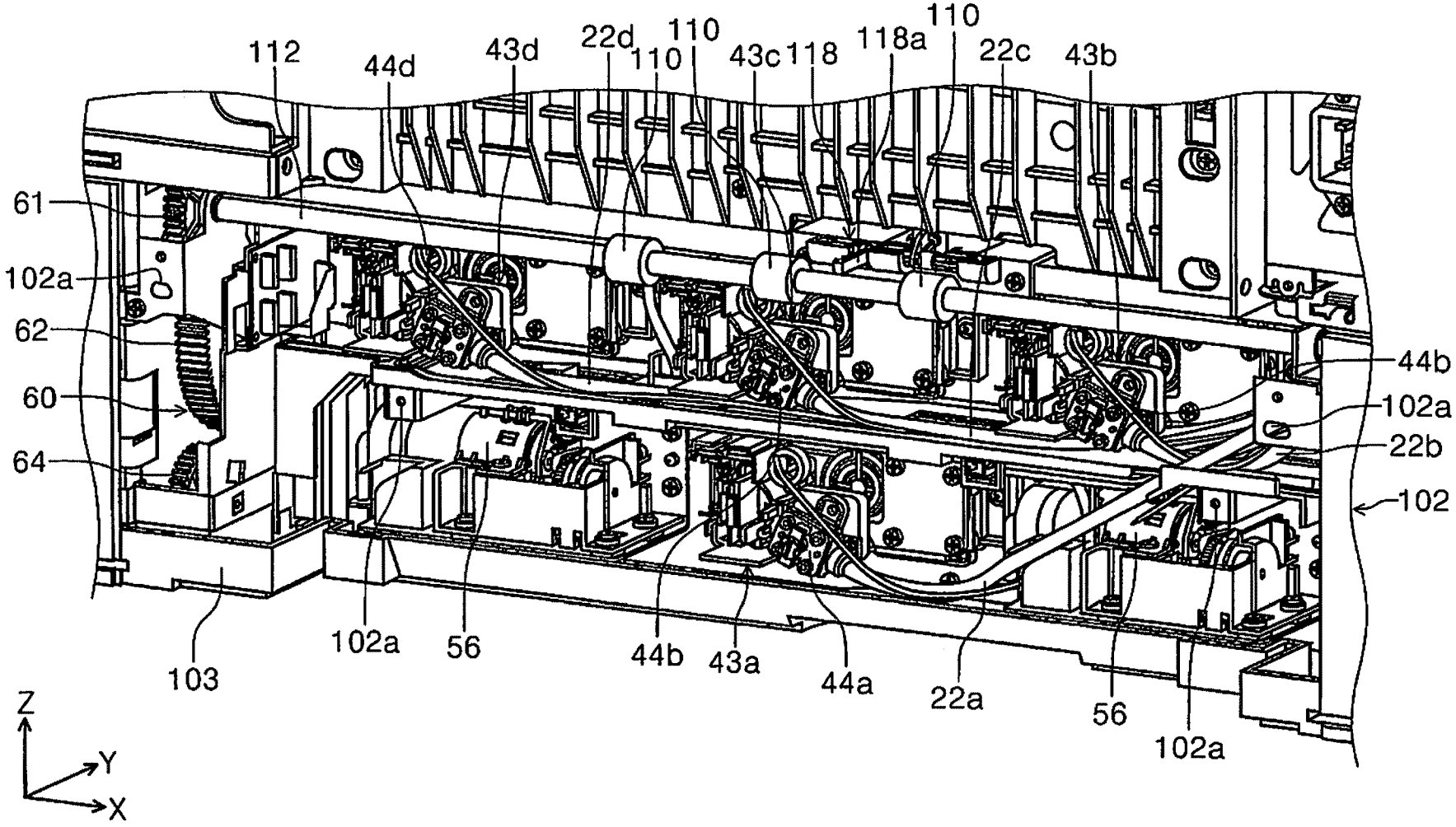
FIG. 30 is a perspective view illustrating a state where an inner cover is detached in a liquid storage unit according to a modification form of the first embodiment.
Figure 31:
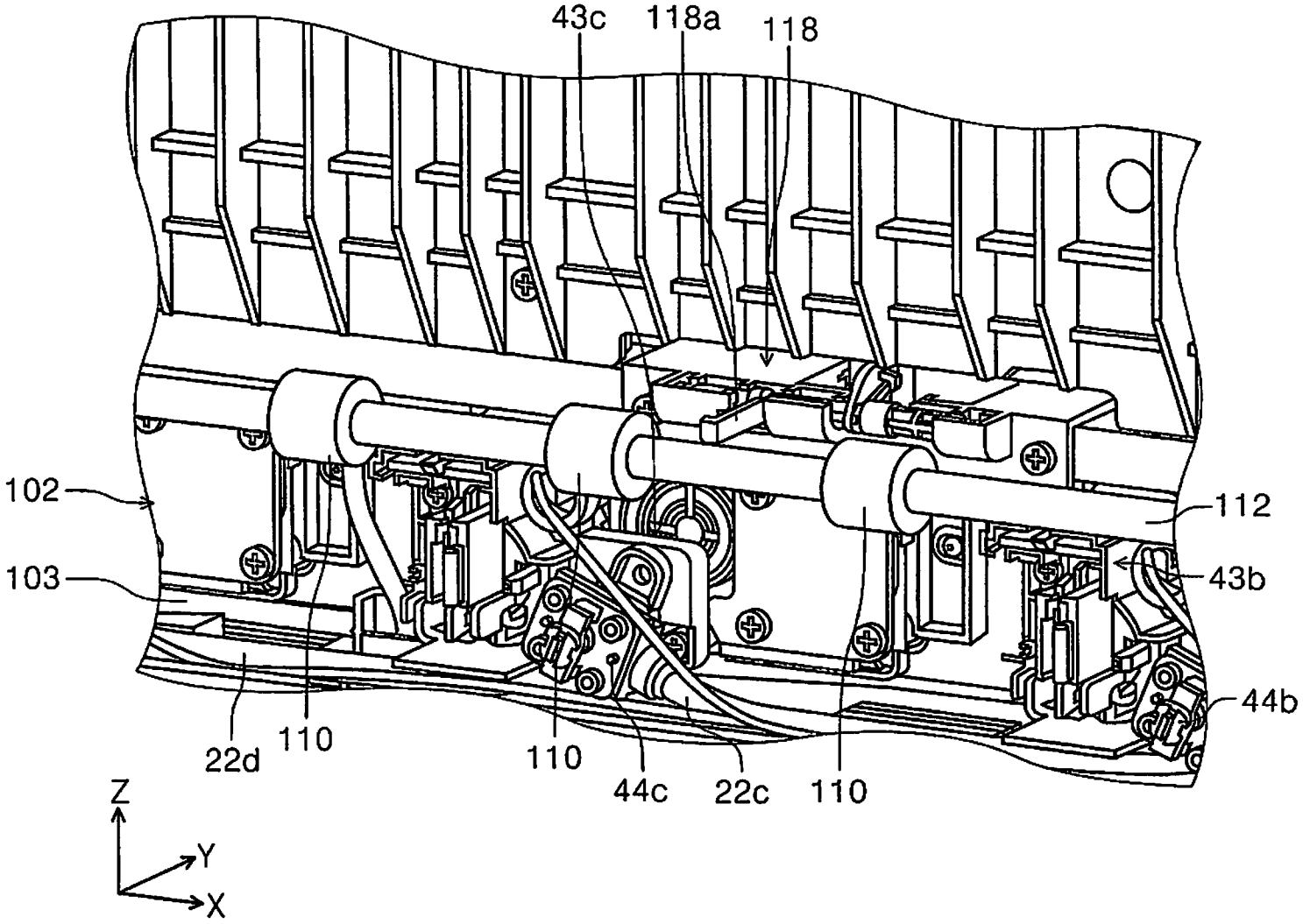
FIG. 31 is an enlarged view illustrating a peripheral portion of the driving roller in FIG. 30.
Figure 32:
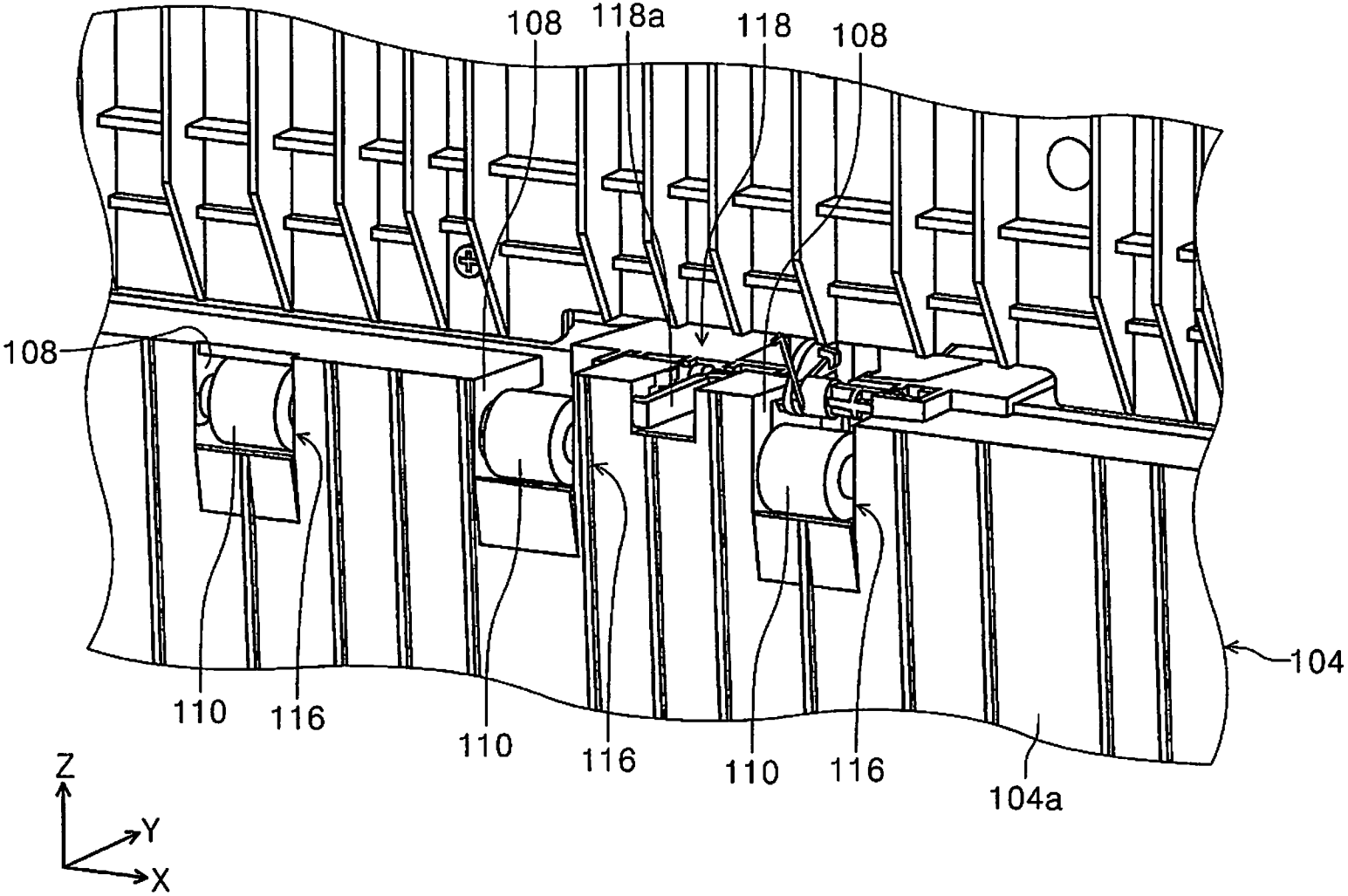
FIG. 32 is an enlarged view illustrating the peripheral portion of the driving roller in a state where the inner cover is attached to the liquid storage unit.
Figure 33:
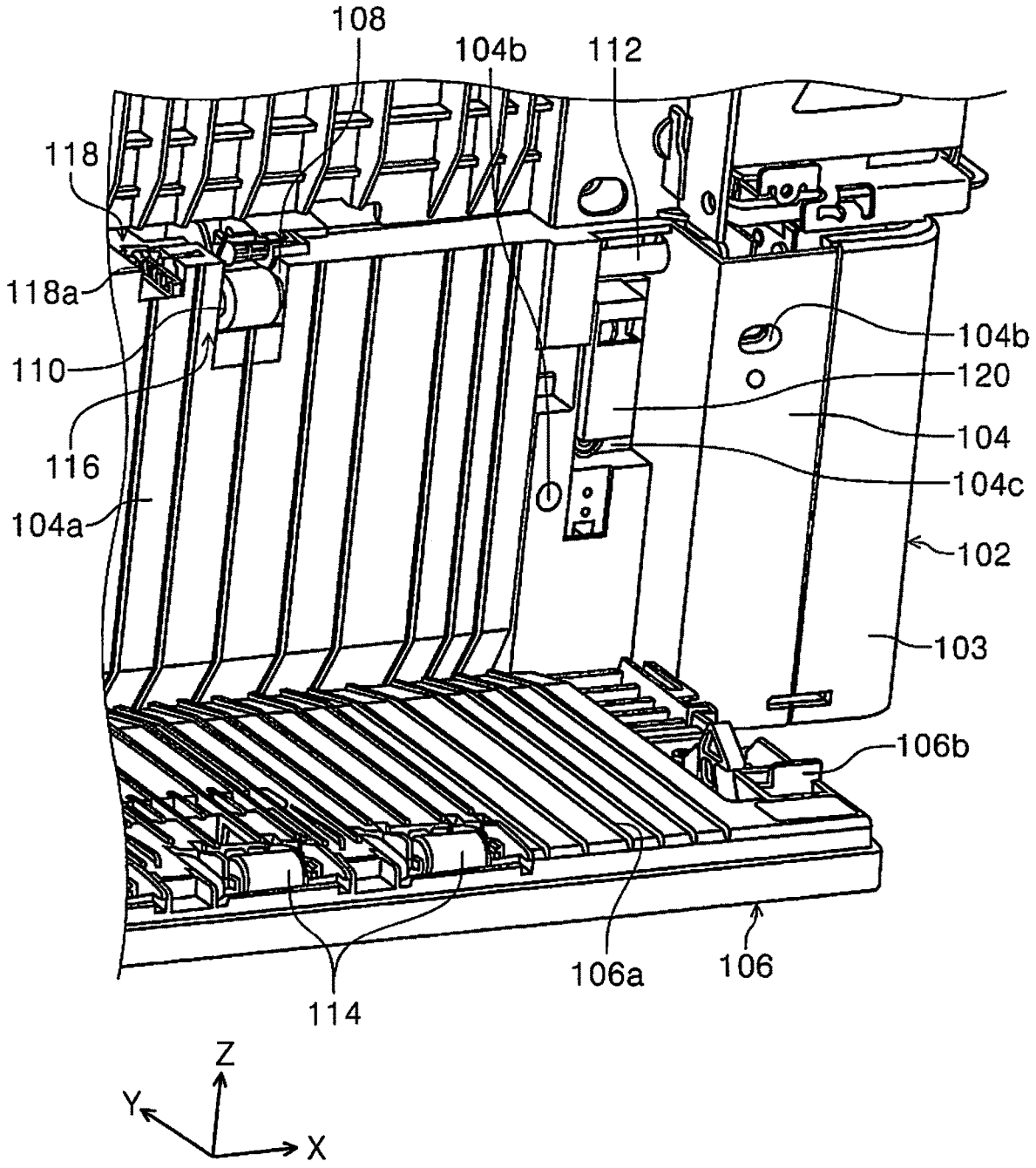
FIG. 33 is a perspective view illustrating back surface cover detecting means.
Figure 34:
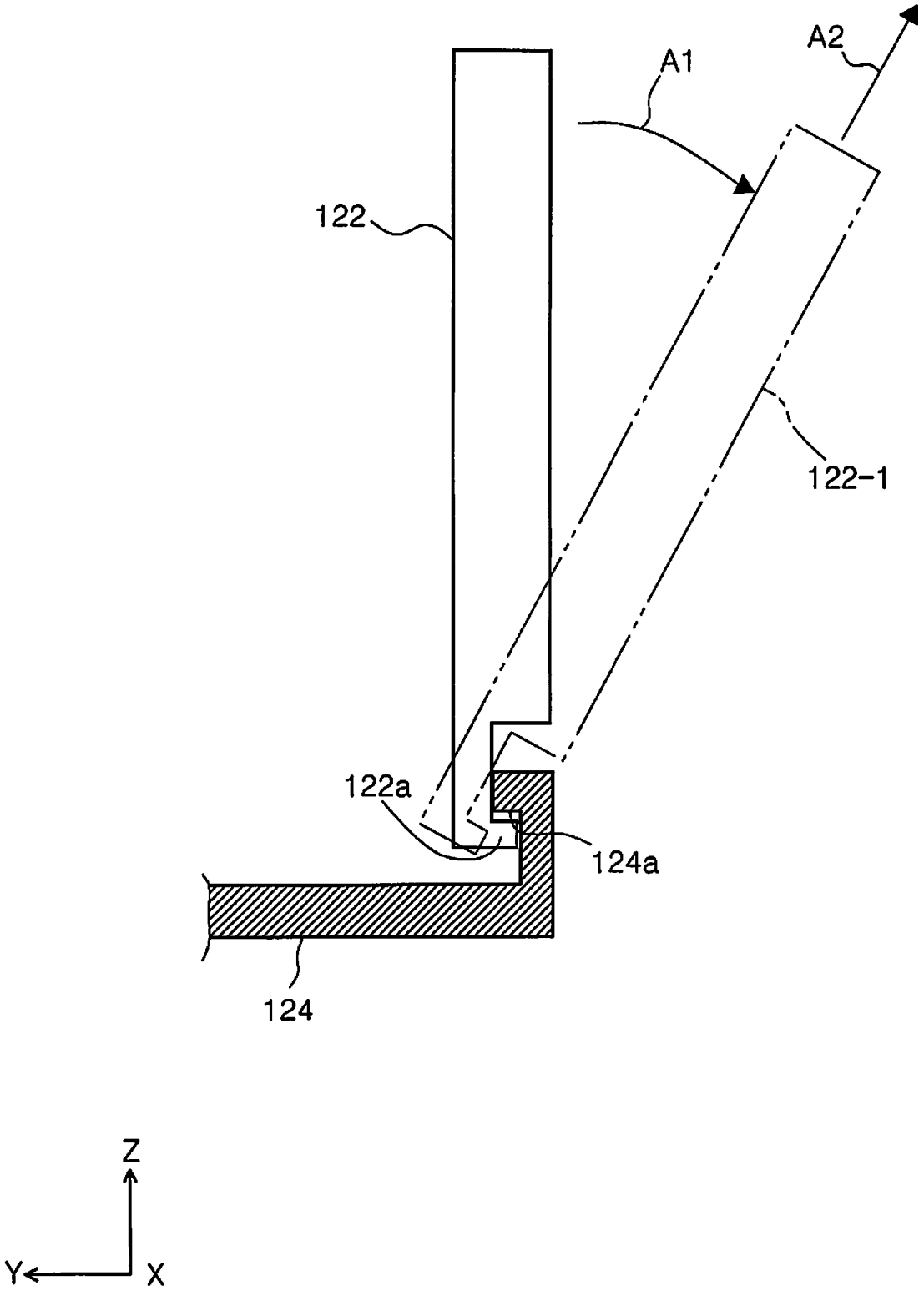
FIG. 34 is a side sectional view illustrating another form of an attachment and detachment structure of the inner cover.

FIG. 30 is a perspective view illustrating a state where an inner cover is detached in a liquid storage unit according to a modification form of the first embodiment, FIG. 31 is an enlarged view illustrating a peripheral portion of the driving roller in FIG. 30, FIG. 32 is an enlarged view illustrating the peripheral portion of the driving roller in a state where the inner cover is attached to the liquid storage unit, FIG. 33 is a perspective view illustrating back surface cover detecting means, and FIG. 34 is a side sectional view illustrating another form of an attachment and detachment structure of the inner cover.

Furthermore, in an X-Y-Z coordinate system illustrated in each drawing, an X direction is a scanning direction of a recording head and a width direction of a medium on which recording is performed. A Y direction is an apparatus depth direction and is a length direction of the medium. A Z direction is a gravity direction and is an apparatus height direction. In addition, a +Y direction side is set as the front side of the apparatus, and a −Y direction side is set as the rear side of the apparatus. Further, a left side is set as a +X direction and a right side is set as a −X direction when viewed from the front side of the apparatus. In addition, a +Z direction is set as an upper part of the apparatus (including an upper portion, an upper surface and the like), and a −Z direction side is set as a lower part of the apparatus (including a lower portion, a lower surface and the like).

In addition, in the specification, the transport direction in which a paper sheet is transported in the printer 1 is referred to as "downstream", and the opposite direction is referred to as "upstream".

Hereinafter, with reference mainly to FIG. 1, an outline of the printer 1 and a paper sheet transport path in the printer 1 will be described.

The printer 1 illustrated in FIG. 1 is configured by stacking a recording unit 2, a liquid storage unit 3, and a medium accommodation unit 4. The recording unit 2, the liquid storage unit 3, and the medium accommodation unit 4 are respectively attachably and detachably configured.

The recording unit 2 includes various configuration portions including a recording head 10 (indicated by a dotted line in FIG. 1) that serves as "recording section" which performs recording on the paper sheet that serves as "medium" on the inside thereof. The recording head 10 is an ink jet type recording head which performs the recording by ejecting the ink that serves as "liquid" on the paper sheet.

Examples of the paper sheet on which the recording is performed in the printer 1 include a plain paper sheet, a thick paper sheet, a photographic paper sheet, and the like.

The printer 1 can be configured not only as a recording function but also as a document reading function, that is, as a multifunction device including a scanner, for example. In the embodiment, a scanner section 5 is provided above the recording unit 2. The scanner section 5 is a flat bed scanner and includes a cover body 5*a* which opens and closes a document table. The cover body 5*a* is configured to be open by rotating around the rear side of the apparatus (−Y direction) similar to the cover body 5*a* indicated by a two-dot chain line in FIG. 1.

On the upper and front side of the apparatus, an operation section 18 which operates the printer 1 including the scanner section 5 is provided.

The liquid storage unit 3 stores liquid accommodation bodies 33*a*, 33*b*, 33*c*, and 33*d* (FIG. 7) which accommodate the ink to be supplied to the recording head 10 therein.

In addition, the medium accommodation unit 4 accommodates the paper sheet to be sent to the recording head 10. In the medium accommodation unit 4, a paper sheet tray 70 that serves as a "medium accommodation section" which accommodates the paper sheet therein is provided so as to be drawn out to the front of the apparatus.

Furthermore, in the embodiment, the recording unit 2 is provided with a built-in tray 6 that serves as "built-in medium accommodation section" which is built in the recording unit 2 and accommodates the paper sheet sent to the recording head 10. The paper sheet accommodated in the paper sheet tray 70 of the medium accommodation unit 4 or in the built-in tray 6 built in the recording unit 2 is fed toward the recording head 10, and recording is performed.

Hereinafter, the configuration of the recording unit 2 will be described, and after this, the configuration of the liquid storage unit 3 and the medium accommodation unit 4 will be described.

Regarding Recording Unit

With reference mainly to FIGS. 2 and 3, the configuration of the recording unit 2 will be described while describing the transport of the paper sheet from the built-in tray 6 (built-in medium accommodation section) of the recording unit 2. Furthermore, in FIG. 2, the description of the scanner section 5 is omitted.

The recording unit 2 is configured to include the built-in tray 6 which accommodates a plurality of paper sheets P in the bottom portion, and to be capable of feeding the paper sheets P one by one from the built-in tray 6. In FIGS. 2 and 3, paths indicated by reference symbols S1 and S2 are "transport paths" in the printer 1. Among the "transport paths", the passing path in any of a case of feeding the paper sheet from the built-in tray 6 and a case of feeding the paper sheet from the paper sheet tray 70 of the medium accommodation unit 4 which will be described later is a common transport path S1. The common transport path S1 is a path from the position indicated by a position A to a position of discharging to a paper discharge tray 17, in FIGS. 2 and 3.

"Transport path" is a path for transporting the paper sheet from the medium accommodation unit 4 to a recording region in which recording is performed by the recording head 10 in the printer 1 in a state where the recording unit 2, the liquid storage unit 3, and the medium accommodation unit 4 are stacked.

The paper sheet P accommodated in the built-in tray 6 is sent from the built-in tray 6 to the common transport path S1 by a feeding roller 7 (also referred to as a pickup roller). Reference numeral 19 indicates a separation roller pair 19 for separating the paper sheet P into a single sheet in a case where the plurality of paper sheets P are fed by the feeding roller 7.

The paper sheet having entered the common transport path S1 is transported toward a first roller 8 and a second roller 9. Furthermore, in FIG. 3, reference numerals 11*a* and 11*b* are driven rollers driven to rotate by the rotation of the first roller 8. Reference numerals 12*a* and 12*b* are driven rollers driven to rotate by the rotation of the second roller 9. In FIG. 2, reference numerals of the driven rollers 11*a* and 11*b* and the driven rollers 12*a* and 12*b* are omitted.

The first roller 8 is a roller that reverses the paper sheet. The paper sheet is bent and reversed by the first roller 8 and sent to the front side of the apparatus (+Y direction), and is further sent by the second roller 9 toward a transport roller pair 13 which will be described later.

The transport roller pair 13 is provided on the downstream side of the second roller 9 in the medium transport direction and on the upstream side of the recording head 10 in the medium transport direction. The transport roller pair 13 transports the paper sheet P to the recording region in which recording is performed by the recording head 10.

In addition, a discharge roller pair 14 is provided on the downstream side of the recording region in the medium transport direction in which recording is performed by the recording head 10.

In the recording region in which recording is performed by the recording head 10 between the transport roller pair 13 and the discharge roller pair 14, the transport roller pair 13 and the discharge roller pair 14 are configured to be capable of transporting the paper sheet P both in the transport direction (+Y direction) and in the opposite direction (−Y direction) in a case where the recording is performed by the recording head 10.

In other words, the transport roller pair 13 and the discharge roller pair 14 are configured to be capable of transporting the paper sheet both in the medium transport direction toward the recording region in which recording is performed by the recording head 10 and in a switchback direction opposite to the medium transport direction.

The transport roller pair 13 and the discharge roller pair 14 are rotationally driven by a driving source, such as a motor which is not illustrated, using each lower roller as the driving roller. The upper roller is driven to rotate by the driving roller.

For example, in a case where the driving source is a motor, the motor is configured to be rotatable both in a directions of normal rotation and reverse rotation, and by switching the rotation direction of the motor, the rotation direction of the transport roller pair 13 and the discharge roller pair 14 is switched. By doing so, the transport roller pair 13 and the discharge roller pair 14 can transport the paper sheet P both in the medium transport direction (+Y direction) and in the switchback direction (−Y direction).

The paper sheet P transported by the second roller 9 is nipped and transported by the transport roller pair 13, and sent to the lower part of the recording head 10.

The recording head 10 is held by a carriage 15 configured to be movable in a width direction (X-axis direction) intersecting with the medium transport direction (Y-axis direction), the ink is ejected to the paper sheet transported to the recording region in which recording is performed by the recording head 10, and accordingly, the recording is performed. A plurality of nozzles (not illustrated) for ejecting the ink are provided on the head surface (the lower surface in FIG. 1) of the recording head 10.

The supply of the ink to the nozzles of the recording head 10 can be performed via tubes 22*a*, 22*b*, 22*c*, and 22*d* (FIG. 4) that serve as "supply path" of the ink from the liquid accommodation bodies 33*a*, 33*b*, 33*c*, and 33*d* (refer to FIG. 4: the liquid accommodation body 33*a* and the liquid accommodation body 33*c* in FIGS. 2 and 3) provided in the liquid storage unit 3 which will be described later.

The tubes 22*a*, 22*b*, 22*c*, and 22*d* supply the ink to the recording head 10 from the liquid accommodation bodies 33*a*, 33*b*, 33*c*, and 33*d* stored in the liquid storage unit 3 in a state (FIGS. 1 and 4) where the recording unit 2, the liquid storage unit 3, and the medium accommodation unit 4 are stacked.

As an example, black ink is accommodated in the liquid accommodation body 33*a*, and the ink of each color of cyan, magenta, and yellow is accommodated in the liquid accommodation bodies 33*b*, 33*c*, and 33*d*, respectively. Furthermore, in FIGS. 2 and 3, the description of the tubes 22*a*, 22*b*, 22*c*, and 22*d* is omitted.

A medium support section 16 which supports the paper sheet P is provided below the recording head 10, that is, at a position opposed to the recording head 10.

The recording is performed by ejecting the ink from the recording head 10 onto the paper sheet that is supported by the medium support section 16 and passes through the recording region.

Furthermore, in the medium support section 16, an adsorption mechanism for adsorbing the paper sheet can be provided on a supporting surface of the medium support section 16. As the adsorption mechanism, for example, suction and adsorption or electrostatic adsorption can be used. The paper sheet P after the recording by the recording head 10 is sent by the discharge roller pair 14 and is discharged to the paper discharge tray 17 provided on the front side of the apparatus.

Further, the printer 1 is configured to be capable of performing double-sided recording in which the recording is performed on a second surface opposite to a first surface after the recording on the first surface of the paper sheet P. In a case of the double-sided recording, after the recording on the first side of the paper sheet P, the paper sheet P is reversed after being sent to a switchback path R (indicated by a one-dot chain line in FIG. 3) by reversing the transport roller pair 13 and the discharge roller pair 14.

More specifically, the paper sheet P transported in the switchback direction (−Y direction) is transported through the switchback path R by the transport roller pair 13 and the discharge roller pair 14 which are reversed. The switchback path R is configured to join the transport path S1 below the first roller 8 through the lower part of the second roller 9 and the first roller 8, and to be transported through the transport path S1 while the paper sheet P is reversed by the first roller 8 again.

The paper sheet reversed by the first roller 8 is transported in the medium transport direction (+Y direction) by the transport roller pair 13 that rotates in the normal direction after being sent by the second roller 9, and is sent to the lower part of the recording head 10 again in a state where the second surface is oriented upward, and accordingly, the recording is performed. The paper sheet P after the recording on the second surface is transported by the discharge roller pair 14 and discharged to the paper discharge tray 17.

Furthermore, in the printer 1, operations related to the recording are controlled by a control section (not illustrated). The control section controls the operation related to the transport of the paper sheet, that is, the driving of various rollers, such as the transport roller pair 13 and the discharge roller pair 14, the recording by the recording head 10, the movement of the carriage 15, and the like.

In addition, the printer 1 can feed the paper sheet by using a manual insertion tray 21 (FIG. 2) by opening a manual insertion cover 20 provided on the rear side of the upper portion of the apparatus in FIG. 1, as illustrated in FIG. 2. Furthermore, the description of the transport of the paper sheet from the manual insertion tray 21 is omitted. Regarding Liquid Storage Unit With reference to FIGS. 3 to 18, the liquid storage unit 3 will be described.

As illustrated in FIG. 5, the liquid storage unit 3 has a positioning projection portion 30 that serves as "first attachment and detachment section" which is attachable to and detachable from the recording unit 2 (also refer to FIG. 16) on the upper side thereof. Furthermore, as illustrated in a third embodiment which will be described later, the positioning projection portion 30 is also configured to be attachable to and detachable from the medium accommodation unit 4. In other words, the positioning projection portion 30 is provided to be attachable to and detachable from either the recording unit 2 or the medium accommodation unit 4, above the liquid storage unit 3.

As illustrated in FIG. 16, the positioning projection portion 30 is inserted into a recess portion 23 provided in the recording unit 2 disposed above the liquid storage unit 3, and can attach the liquid storage unit 3 and a unit (the recording unit 2 in the embodiment) provided above the liquid storage unit 3 such that a predetermined positional relationship, for example, the exterior, becomes flush.

By inserting the positioning projection portion 30 into the recess portion 23 provided in the bottom portion of the recording unit 2, the liquid storage unit 3 and the recording unit 2 can be connected to each other and can be easily assembled to the printer 1.

Furthermore, a lock mechanism (not illustrated) for locking the connection between the connected recording unit 2 and the liquid storage unit 3 can be provided. This also applies to the connection between the liquid storage unit 3 and the medium accommodation unit 4, which will be described later.

Further, in the embodiment, the exterior of each of the recording unit 2, the liquid storage unit 3, and the medium accommodation unit 4 configures the exterior of the printer 1 itself, but, for example, after connecting each unit to each other, it is also possible to cover the exterior with an exterior case configured to cover at least a part of the apparatus side surface, the front surface, and the back surface such that a joint between the units are not seen.

In the liquid storage unit 3, an upper surface portion 31 which covers a part of the upper portion is formed of sheet metal, and is configured such that the weight of a unit attached to the upper side can be received by sheet metal.

The positioning projection portion 30 is provided on the upper surface portion 31 of the sheet metal.

Furthermore, as illustrated in FIG. 16, below the liquid storage unit 3, a positioning recess portion 32 that serves as "second attachment and detachment section" which is attachable to and detachable from the medium accommodation unit 4 disposed below the liquid storage unit 3 is provided. The positioning recess portion 32 will be described later.

Regarding First Storage Section and Second Storage Section

Next, the liquid storage unit 3 includes: a first storage section 34 which is capable of storing the plurality of the liquid accommodation bodies 33*a*, 33*b*, 33*c*, and 33*d* therein as illustrated in FIG. 4, and stores one liquid accommodation body 33*a* therein as illustrated in FIG. 6; and a second storage section 35 which is provided above the first storage section 34 and stores the remaining liquid accommodation bodies 33*b*, 33*c*, and 33*d*. In the embodiment, the first storage section 34 and the second storage section 35 are partitioned by a shelf plate 36.

As the liquid storage unit 3 includes the first storage section 34 and the second storage section 35 disposed in two stages, it is possible to efficiently contain the plurality of liquid accommodation bodies 33*a*, 33*b*, 33*c*, and 33*d*.

As shown in FIG. 6, the liquid storage unit 3 includes an opening/closing cover 37 which opens and closes on the front side (+Y direction), and when the opening/closing cover 37 is open, the first storage section 34 and the second storage section 35 can be drawn out to the front of the apparatus (+Y direction).

More specifically, the first storage section 34 includes a drawable tray 38*a* which can be drawn out to the front of the apparatus (+Y direction), and performs the attachment and detachment of the liquid accommodation body 33*a* stored in a drawable tray 38*a* by drawing out the drawable tray 38*a*. In addition, the second storage section 35 includes drawable trays 38*b*, 38*c*, and 38*d* individually provided for the liquid accommodation bodies 33*b*, 33*c*, and 33*d*. The drawable trays 38*b*, 38*c* and 38*d* can be drawn out to the front of the apparatus (+Y direction), respectively. By doing so, it is possible to easily perform the exchange of the liquid accommodation bodies 33*b*, 33*c*, and 33*d* stored in the drawable trays 38*b*, 38*c*, and 38*d*.

Furthermore, the drawable trays 38*b*, 38*c*, and 38*d* provided in the second storage section 35 may be configured as one tray such that the liquid accommodation bodies 33*b*, 33*c*, and 33*d* can be disposed side by side.

A pair of regulating sections 46 is provided on both sides in the direction (X-axis direction) intersecting with the drawing-out direction of the drawable tray 38*a* on the inside the opening/closing cover 37.

The regulating section 46 is a member which regulates the position in the direction (X-axis direction) intersecting with the drawing-out direction of the drawable tray 38*a* when drawing out or inserting the drawable tray 38*a* as illustrated in FIG. 7.

Before the insertion, the drawn-out drawable tray 38*a* can be supported by an edge 37*a* (FIG. 7) of the opening/closing cover 37. Since the drawable tray 38*a* is supported by the edge 37*a* of the opening/closing cover 37, drawing or insertion of the drawable tray 38*a* can be stably and smoothly performed.

Further, as illustrated in FIG. 8, the opening/closing cover 37 is held in an open state by a holding section 39 of which one end side is attached to the opening/closing cover 37 and the other end side is attached to a housing 40 that configures the external appearance of the liquid storage unit 3.

The holding section 39 includes a guide groove 41, and a projected fixing section 42 provided on the inside of the housing 40 is engaged with the guide groove 41, and when the opening/closing cover 37 is open and closed, the fixing section 42 to be fixed moves relative to the guide groove 41.

As illustrated in FIG. 6, the holding section 39 is provided on both sides in the direction (X-axis direction) intersecting with the drawing-out direction of the drawable trays 38*a*, 38*b*, 38*c*, and 38*d*.

Regarding Supply Connection Section

In addition, as illustrated in FIG. 13, a supply connection section 43*a* for the liquid accommodation body 33*a* is provided on the rear side of the apparatus (−Y direction) of the first storage section 34, a plurality of supply connection sections 43*b*, 43*c*, and 43*d* for the liquid accommodation bodies 33*b*, 33*c*, and 33*d* are provided on the rear side of the apparatus of the second storage section 35 (also refer to FIG. 9).

In other words, each of the supply connection sections 43*a*, 43*b*, 43*c*, and 43*d* for the plurality of liquid accommodation bodies 33*a*, 33*b*, 33*c*, and 33*d* are disposed on the rear side of the apparatus.

The supply connection sections 43*a*, 43*b*, 43*c*, and 43*d* illustrated in FIG. 13 respectively connect the corresponding liquid accommodation bodies 33*a*, 33*b*, 33*c*, and 33*d* (FIGS. 4 and 7) and the tubes 22*a*, 22*b*, 22*c*, and 22*d* (also refer to FIG. 4) to each other to be disconnected from each other.

In FIG. 13, in the end portion of the tubes 22*a*, 22*b*, 22*c*, and 22*d* on the side near to the supply connection sections 43*a*, 43*b*, 43*c*, and 43*d*, attachment and detachment sections 44*a*, 44*b*, 44*c*, and 44*d* which are parts for performing the connection and disconnection of the supply connection sections 43*a*, 43*b*, 43*c*, and 43*d* are provided. Both of the supply connection sections 43*a*, 43*b*, 43*c*, and 43*d* and the attachment and detachment sections 44*a*, 44*b*, 44*c*, and 44*d* are provided with check valves (not illustrated), and the ink does not leak even when removing the attachment and detachment sections 44*a*, 44*b*, 44*c*, and 44*d*.

Furthermore, only the parts close to the attachment and detachment sections 44*a*, 44*b*, 44*c*, and 44*d* of the tubes 22*a*, 22*b*, 22*c*, and 22*d* in FIG. 13 are described, and the rest are omitted.

In addition, as illustrated in FIG. 13, on the rear side of the liquid storage unit 3, pumps 56 are provided on both sides of the supply connection section 43*a*. The inside of the tubes 22*a*, 22*b*, 22*c*, and 22*d* can be pressurized by the pump 56 and the ink can be pressure-fed.

As illustrated in FIG. 15, a needle 45 (also refer to FIG. 3) is provided on the +Y direction side of the supply connection sections 43*a*, 43*b*, 43*c*, and 43*d*. FIG. 15 illustrates only the supply connection section 43*a* as a representative, but the other supply connection sections 43*b*, 43*c*, and 43*d* have similar configurations.

In FIG. 15, the needle 45 is inserted in the liquid accommodation body 33*a*. The needle 45 is formed to be hollow and sends the ink in the liquid accommodation body 33*a* from the needle 45 to the tube 22*a* via the supply connection section 43*a*.

When the drawable tray 38*a* is drawn out to the front of the apparatus (+Y direction side), since the liquid accommodation body 33*a* also moves toward the front side of the apparatus, the liquid accommodation body 33*a* is drawn out from the needle 45 and detached. Conversely, in a case of mounting the liquid accommodation body 33*a*, the needle 45 is inserted into the liquid accommodation body 33*a* by setting the liquid accommodation body 33*a* in the drawable tray 38*a* and by inserting the drawable tray 38*a* to the end.

In addition, as illustrated in FIG. 14, in the direction (X-axis direction) intersecting with the drawing-out direction of the drawable tray 38*a* that configures the first storage section 34 and the drawable trays 38*b*, 38*c*, and 38*d* that configure the second storage section 35, the width of the first storage section 34 is narrower than the width of the second storage section 35. Since the width of the first storage section 34 is narrower than the width of the second storage section 35, the empty space below the second storage section 35 in FIG. 14 can be used, for example, as a space for disposing other configuration portions. In the embodiment, the positioning recess portion 32 is provided in the space.

The positioning recess portion 32 is "second attachment and detachment section" which is attachable to and detachable from the medium accommodation unit 4 disposed below the liquid storage unit 3.

As illustrated in FIG. 16, the positioning recess portion 32 is a configuration portion which has an opening formed in the bottom portion of the liquid storage unit 3 and receives a projection portion 76 provided above the medium accommodation unit 4. By engaging the projection portion 76 of the medium accommodation unit 4 to the positioning recess portion 32 of the liquid storage unit 3, the liquid storage unit 3 and the medium accommodation unit 4 provided below the liquid storage unit 3 can be attached such that the exterior thereof becomes flush. Therefore, it is possible to easily connect the liquid storage unit 3 and the medium accommodation unit 4 to each other.

Regarding First Transport Path

As illustrated in FIG. 3, the printer 1 includes an upstream side transport path S2 that configures "transport path" for transporting the paper sheet from the medium accommodation unit 4 to the recording region in which recording is performed by the recording head 10 in a state where the recording unit 2, the liquid storage unit 3, and the medium accommodation unit 4 are stacked (also refer to FIG. 2). In FIGS. 2 and 3, the upstream side transport path S2 is a transport path further on the upstream side (−Z direction side) in the medium transport direction than the position A, and the recording is performed as the paper sheet fed from the medium accommodation unit 4 provided below the liquid storage unit 3 enters the common transport path S1 from the upstream side transport path S2.

In addition, the liquid storage unit 3 includes a first transport path T that serves as "storage unit inner transport path" which forms a part of the upstream side transport path S2 (transport path) and includes a first transport section 55 (FIG. 3) that serves as "transport section" which transports the paper sheet.

As the liquid storage unit 3 has the first transport path T, in a case where the medium accommodation unit 4 is provided below the liquid storage unit 3, the paper sheet fed from the medium accommodation unit 4 is passed through the liquid storage unit 3 and can be sent to the recording unit 2 positioned above the liquid storage unit 3.

In other words, as the liquid storage unit 3 has the first transport path T, as described in the embodiment, the configuration of the printer 1 in which the medium accommodation unit 4 is provided below the liquid storage unit 3 can be realized. Therefore, in a case where the printer is assembled by stacking the recording unit 2, the liquid storage unit 3, and the medium accommodation unit 4, the liquid storage unit 3 can be disposed at a more appropriate position.

Further, the printer 1 can be configured by attaching and detaching the recording unit 2, the medium accommodation unit 4, and the liquid storage unit 3, it is possible to combine each of the units after separately manufacturing each of the units, and thus, the assembly of the printer 1 becomes easy.

In the liquid storage unit 3 of the embodiment, the first transport path T is provided on the rear side of the apparatus (−Y direction) with respect to the supply connection sections 43*a*, 43*b*, 43*c*, and 43*d* (FIGS. 3 and 17).

Hereinafter, a specific configuration of the first transport path T provided in the liquid storage unit 3 will be described.

On the rear (−Y direction) side of the liquid storage unit 3, as illustrated in FIG. 11, a back surface cover 50 is provided. When the back surface cover 50 is open as illustrated in FIG. 12, an inner cover 51 is exposed. In addition, on the inside of the back surface cover 50 illustrated in FIG. 12, a first driven roller 53 that configures the first transport section 55 is provided. The first driving roller 54 which configures the first transport section 55 while being a pair with the first driven roller 53 is configured such that a rotating shaft 54*a* is attached to the inside (on the +Y direction side) of the inner cover 51, and a first driving roller 54 is exposed to the first driven roller 53 side from a window portion 57 (FIG. 17) provided in the inner cover 51, and comes into contact with the first driven roller 53.

As illustrated in FIGS. 12 and 17, the inner cover 51 has a shape that is recessed in the +Y direction in a case where the liquid storage unit 3 is viewed from above, and the paper sheet can pass between the back surface cover 50 and the inner cover 51. The region between the back surface cover 50 and the inner cover 51 is the first transport path T.

As the first transport path T is provided on the rear side of the apparatus, the first transport path T can be configured so as not to affect the drawing of the drawable trays 38*a*, 38*b*, 38*c*, and 38*d*.

The back surface cover 50 can be easily open and closed by a user, for example, in order to remove a paper jam in the first transport path T, maintenance, and the like.

Meanwhile, when the inner cover 51 is removed, as illustrated in FIG. 13, the supply connection sections 43*a*, 43*b*, 43*c*, and 43*d* or the attachment and detachment sections 44*a*, 44*b*, 44*c*, and 44*d* or the pump 56 are exposed. The inner cover 51 is fixed by fixing screws or the like (not illustrated) such that the user cannot easily touch the exposed sections.

In addition, the first driving roller 54 of the first transport section 55 provided in the first transport path T is configured to be driven by transmitting the power by a power transmission section 60 from a second transport section 75 which will be described later. The second transport section 75 is provided in the medium accommodation unit 4.

The configuration of the power transmission section 60 will be described after describing the medium accommodation unit 4.

Regarding Medium Accommodation Unit

The medium accommodation unit 4 illustrated in FIGS. 1 and 2 includes the paper sheet tray 70 which can be drawn out to the front side of the apparatus (+Y direction). In FIGS. 2 and 3, a feeding roller 71 that serves as "feeding section" is provided at the rear part of the apparatus (−Y direction) of the paper sheet tray 70. The feeding roller 71 sends out the paper sheet P accommodated in the paper sheet tray 70 to the upstream side transport path S2 behind the apparatus.

On the downstream side in the feeding direction of the feeding roller 71, a separation roller pair 72 is provided. The separation roller pair 72 separates the paper sheet into one sheet in a case where the plurality of paper sheets are sent by the feeding roller 71.

In FIG. 3, on the downstream side of the separation roller pair 72, the second transport section 75 is provided. The second transport section 75 includes a second driven roller 73 and a second driving roller 74. The feeding roller 71, the driving roller of the separation roller pair 72, and the second driving roller 74 are driven by a driving source (not illustrated) provided in the medium accommodation unit 4. The second transport section 75 sends the paper sheet to the first transport path T of the liquid storage unit 3. The paper sheet fed from the medium accommodation unit 4 passes through the upstream side transport path S2 including the first transport path T and further passes through the common transport path S1 to the recording region in which recording is performed by the recording head 10.

Above the medium accommodation unit 4, as illustrated in FIG. 16, the projection portion 76 to be inserted into the positioning recess portion 32 of the liquid storage unit 3 is provided. In addition, as illustrated in FIG. 16, a recess portion 77 is provided below the medium accommodation unit 4. The recess portion 77 can be used to connect a unit disposed below the medium accommodation unit 4 (for example, a second medium accommodation unit 4A indicated by a dotted line in FIG. 16). A projection portion 76A provided above the second medium accommodation unit 4A is inserted into the recess portion 77, and the medium accommodation unit 4 and the second medium accommodation unit 4A can be connected to each other. Accordingly, a printer in which two or more medium accommodation units are stacked can be easily formed, and expandability of the apparatus increases.

Other Constructions in Liquid Storage Unit

Hereinafter, other configurations in the liquid storage unit 3 will be described.

The liquid storage unit 3 includes a power transmission section 60 which transmits the power of the second transport section 75 for transporting the paper sheet provided in the medium accommodation unit 4 mounted in the positioning recess portion 32, to the first transport section 55. According to this, it is possible to drive the first transport section 55 using the power of the second transport section 75 provided in the medium accommodation unit 4 mounted in the positioning recess portion 32.

Hereinafter, with reference to FIG. 17, a specific configuration of the power transmission section 60 will be described.

The power transmission section 60 illustrated in FIG. 17 includes a first gear 61 provided in the end portion of the rotating shaft 54*a* of the first driving roller 54, a second gear 62 that meshes with the first gear 61, a third gear 63 that meshes with the second gear 62, and a fourth gear 64 that meshes with the third gear 63.

A part of the fourth gear 64 is exposed to the lower outside from an opening portion 52 (also refer to FIG. 10) provided at the bottom of the housing 40.

In addition, a gear (not illustrated) provided in the end portion of the rotating shaft of the second driving roller 74 of the second transport section 75 illustrated in FIG. 3 meshes with a part of the fourth gear 64 exposed from the opening portion 52. According to this, a rotating force of the second driving roller 74 is transmitted to the fourth gear 64, and further, the rotating force of the second driving roller 74 is transmitted to the first gear 61 via the third gear 63 and the second gear 62.

Therefore, the first driving roller 54 (first transport section 55) provided in the liquid storage unit 3 can be driven by using the power of the second driving roller 74 (second transport section 75) provided in the medium accommodation unit 4 disposed below the liquid storage unit 3.

Below the housing 40 that configures the liquid storage unit 3, as illustrated in FIG. 10, there is a receiving section 47 formed by surrounding a bottom surface 58 of the housing 40 by side walls 48*a* and 48*b* on both sides in the X-axis direction, ribs 49*a* and 49*b* provided on both sides in the Y-axis direction, and a rib 49*c* provided around the opening portion 52. The receiving section 47 can receive the ink which leaked inadvertently from the liquid accommodation bodies 33*a*, 33*b*, 33*c*, and 33*d*.

In the embodiment, the receiving section 47 is provided integrally with the housing 40, but it is also possible to provide a tray-shaped receiving section separated from the housing 40. Similar to the drawable trays 38*a*, 38*b*, 38*c*, and 38*d*, for example, the tray-shaped receiving section can also be configured to be drawn out to the +Y direction side.

In summary of the liquid storage unit 3 described in the first embodiment, the liquid storage unit 3 has the following configuration.

In other words, the liquid storage unit 3 can configure the recording apparatus being provided below the recording unit 2, and includes the first storage section 34 and the second storage section 35 that serve as "storage section" for storing the liquid accommodation bodies 33*a*, 33*b*, 33*c*, and 33*d* which accommodate the ink to be supplied to the recording head 10.

In addition, liquid storage unit 3 includes: the positioning projection portion 30 that serves as "first attachment and detachment section" which is provided above the liquid storage unit 3 and is attachable to and detachable from either the recording unit 2 or the medium accommodation unit 4; and the positioning recess portion 32 that serves as "second attachment and detachment section" which is provided below the liquid storage unit 3 and attachable to and detachable from the medium accommodation unit 4.

Further, the liquid storage unit 3 includes: the supply connection sections 43*a*, 43*b*, 43*c*, and 43*d* which connect the liquid accommodation bodies 33*a*, 33*b*, 33*c*, and 33*d* and the tubes 22*a*, 22*b*, 22*c*, and 22*d* that serve as "supply path" for supplying the ink to the recording head 10 from the liquid accommodation bodies 33*a*, 33*b*, 33*c*, and 33*d* to each other to be disconnected from each other in a state where the recording unit 2 or the medium accommodation unit 4 is mounted in the positioning projection portion 30; and the first transport path T which forms a part of the upstream side transport path S2 that serves as "transport path" for transporting the paper sheet from the medium accommodation unit 4 to the recording region in which recording is performed by the recording head 10 in a state where the medium accommodation unit 4 is mounted in the positioning recess portion 32 and includes the first transport section 55 for transporting the paper sheet.

As the liquid storage unit 3 is configured as described above, it is possible to easily form the printer 1 by stacking the liquid storage unit 3 and the recording unit 2, or the liquid storage unit 3, the recording unit 2, and the medium accommodation unit 4.

Further, the liquid storage unit 3 can be disposed at an appropriate position. In the embodiment, since the liquid storage unit 3 is disposed below the recording unit 2, for example, even when the ink leaks inadvertently from the liquid storage unit 3, it is possible to reduce a concern that the leaking ink adheres to the recording unit 2.

In addition, since the liquid storage unit 3 includes the positioning recess portion 32 and the first transport path T, it is possible to mount the medium accommodation unit 4 below the liquid storage unit 3, that is, it is possible to improve expandability of the printer 1.

Furthermore, similar to the recording unit 2 of the embodiment, in a case where the recording unit 2 includes the built-in tray 6, as illustrated in FIG. 18, it is possible to form a printer 1A having a more compact configuration by stacking only the recording unit 2 and the liquid storage unit 3 without attaching the medium accommodation unit 4 to the lowermost stage. In this manner, it is possible to increase the degree of freedom of the configuration of the printer.

Furthermore, in the embodiment, by the supply connection sections 43*a*, 43*b*, 43*c*, and 43*d*, the liquid accommodation bodies 33*a*, 33*b*, 33*c*, and 33*d* and the tubes 22*a*, 22*b*, 22*c*, and 22*d* which supply the ink from the liquid accommodation bodies 33*a*, 33*b*, 33*c*, and 33*d* to the recording head 10 can be disconnected from each other, and each of the liquid accommodation bodies 33*a*, 33*b*, 33*c*, and 33*d* is configured to be exchangeable.

Instead of the configuration, for example, the supply connection sections 43*a*, 43*b*, 43*c*, and 43*d* may be configured to connect the liquid accommodation bodies 33*a*, 33*b*, 33*c*, and 33*d* and the tubes 22*a*, 22*b*, 22*c*, and 22*d* to each other without disconnection. According to the configuration, it is possible to refill the ink in a state where the liquid accommodation bodies 33*a*, 33*b*, 33*c*, and 33*d* are stored in the first storage section 34 and the second storage section 35 without being disconnected from the tubes 22*a*, 22*b*, 22*c*, and 22*d*.

Modification Form of Liquid Storage Unit

A modification form of the liquid storage unit will be described with reference to FIGS. 26 to 33. The modification form relates mainly to the configuration of the inner cover and the back surface cover, and the configuration of the recording unit 2 is the same as that of the first embodiment. Furthermore, in FIGS. 26, 27, 30 and 33, illustration of the medium accommodation unit 4 is omitted.

In FIG. 26, the printer 100 includes the recording unit 2 and a liquid storage unit 102. In the modification form, the liquid storage unit 102 includes a liquid storage unit main body 103, an inner cover 104 that serves as "inner member", and a back surface cover 106 that serves as "outer member". The inner cover 104 and the back surface cover 106 are provided in the end portion on the −Y direction side (back surface side) of the liquid storage unit main body 103. In the modification form, the back surface cover 106 is configured to be switchable between a closed state (not illustrated) and an open state (FIGS. 26 to 28 and 33) with respect to the inner cover 104. Specifically, the back surface cover 106 is attached to the inner cover 104 so as to be rotatable with respect to the inner cover 104 using the end portion on the −Z direction side as a pivot point.

In the inner cover 104, a surface (back surface) on the −Y direction side is configured as a path forming surface 104*a*. Meanwhile, in the back surface cover 106, the surface on the +Z direction side in FIGS. 26 and 28 is configured as a path forming surface 106*a*. Although not illustrated, in the modification form, when the back surface cover 106 is in a closed state with respect to the inner cover 104, the path forming surface 104*a* and the path forming surface 106*a* are in an opposing state at intervals in the Y-axis direction. Accordingly, a first transport path T (FIGS. 2 and 3) that serves as the liquid storage unit inner transport path that extends in the Z-axis direction is formed between the back surface cover 106 and the inner cover 104 in the closed state.

In the modification form, as illustrated in FIGS. 27 to 29, the inner cover 104 is provided with a plurality of fastening sections 104*b*. As an example, four fastening sections 104*b* are provided. As illustrated in FIG. 30, in the end portion on the −Y direction side of the liquid storage unit main body 103, fastened sections 102*a* of which the number corresponds to the number of the fastening sections 104*b* are formed. As an example, four fastened sections 102*a* are provided.

In the modification form, the inner cover 104 is fixed to the liquid storage unit main body 103 by fastening the fastening section 104*b* to the fastened section 102*a* with a fastening member (not illustrated). The fastening member (not illustrated) is configured by screws, bolts or the like as an example.

By loosening and detaching the fastening member (not illustrated) from the inner cover 104, the inner cover 104 can be detached from the liquid storage unit main body 103. In the modification form, as illustrated in FIGS. 28 and 29, the inner cover 104 is configured to be detachable from the liquid storage unit main body 103 together with the back surface cover 106. In the modification form, by detaching the four fastening members from the inner cover 104, the inner cover 104 is detached from the liquid storage unit main body 103 together with the back surface cover 106, the supply connection sections 43*a*, 43*b*, 43*c*, and 43*d* and the pump 56 can be exposed. As a result, it is possible to easily perform the work of accessing the supply connection sections 43*a*, 43*b*, 43*c*, and 43*d* and the pump 56, and to improve workability of maintenance.

In the end portion on the +Z direction side of the inner cover 104, a plurality of window portions 108 are formed at intervals in the X-axis direction. As illustrated in FIG. 32, in a state where the inner cover 104 is attached to the liquid storage unit main body 103, the driving roller 110 is disposed in the window portion 108. In this state, at least a part of the driving roller 110 protrudes further to the −Y direction side than the path forming surface 104*a* of the inner cover 104, that is, into the first transport path T.

In the modification form, the plurality of driving rollers 110 are attached to a rotating shaft 112 at intervals in the X-axis direction as illustrated in FIGS. 30 and 31. The rotating shaft 112 is rotatably attached to the liquid storage unit main body 103 as illustrated in FIG. 30. The rotating shaft 112 is configured to rotate by receiving the driving force from the first gear 61 of the first power transmission section 60 disposed in the end portion on the −X direction side of the rotating shaft 112. Accordingly, the driving roller 110 also rotates together with the rotating shaft 112.

On the back surface cover 106, driven rollers 114 are disposed at intervals in the X-axis direction such that a part thereof protrudes from the path forming surface 106*a*. In the back surface cover 106, the driven rollers 114 of which the number corresponds to the number of the driving rollers 110 are disposed.

When the back surface cover 106 is in a closed state with respect to the inner cover 104, the driven roller 114 abuts against the driving roller 110 to form a nipped state. Conversely, when the back surface cover 106 is rotated from the closed state to the open state with respect to the inner cover 104, the nipped state between the driving roller 110 and the driven roller 114 is released, and the inner cover 104 is exposed. Furthermore, in the modification form, the driving roller 110 and the driven roller 114 configure a first transport section 116 (FIG. 26 or the like) that serves as "transport section" in the first transport path T.

In the modification form, the driving roller 110 and the rotating shaft 112 are attached to the liquid storage unit main body 103. As a result, as illustrated in FIGS. 30 and 31, in a case where the inner cover 104 is detached from the liquid storage unit main body 103 together with the back surface cover 106, the driving roller 110 and the rotating shaft 112 are held by the liquid storage unit main body 103 and are held on the liquid storage unit main body 103 side. Since the driving roller 110 is disposed in the window portion 108 formed in the inner cover 104, when attaching and detaching the inner cover 104 to and from the liquid storage unit main body 103, it is possible to suppress interference of the inner cover 104 and the driving roller 110. Furthermore, in a case where the inner cover 104 is detached from the liquid storage unit main body 103 together with the back surface cover 106, the driven roller 114 is detached from the liquid storage unit main body 103 together with the back surface cover 106.

Here, in the configuration in which the driving roller 110 and the rotating shaft 112 are attached to the inner cover 104, every time the inner cover 104 is attached to and detached from the liquid storage unit 102, the driving roller 110 and the rotating shaft 112 are detached from or attached to the liquid storage unit main body 103. As a result, there is a case where it becomes impossible to stabilize the assembly accuracy of the rotating shaft 112 with respect to the liquid storage unit main body 103, for example, parallelism or the like with respect to the first transport path T of the driving roller 110.

In the modification form, since the driving roller 110 and the rotating shaft 112 are held by the liquid storage unit main body 103, even when the inner cover 104 is attached to and detached from the liquid storage unit main body 103, it is possible to maintain the assembly accuracy of the rotating shaft 112 with respect to the liquid storage unit main body 103. As a result, it is possible to prevent deterioration of the transport accuracy of the medium in the first transport path T.

In FIGS. 30 to 33, in the end portion on the −Y direction side of the liquid storage unit main body 103, a medium passage detection sensor 118 is disposed at a position that corresponds to the end portion on the +Z direction side of the inner cover 104. The medium passage detection sensor 118 includes a detection lever 118*a* that protrudes toward the inside of the first transport path T. The detection lever 118*a* is configured to be rotatable. When the medium is transported from the medium accommodation unit 4 (FIGS. 1 to 3) toward the recording head 10 (FIGS. 2 and 3) of the recording unit 2 in the first transport path T, a tip end of the medium transported in the first transport path T pushes up and rotates the detection lever 118*a*. Accordingly, the medium passage detection sensor 118 can detect the transport of the medium in the first transport path T.

In the modification form, the medium passage detection sensor 118 is provided in the liquid storage unit main body 103. Accordingly, when attaching and detaching the inner cover 104 to and from the liquid storage unit main body 103, it is not necessary to detach the medium passage detection sensor 118 from the liquid storage unit main body 103, and thus, the medium detection accuracy due to attachment and detachment of the sensor does not deteriorate, and the medium detection accuracy can be stabilized.

As illustrated in FIGS. 28 and 33, a recess portion 104*c* which is recessed on the +Y direction side is formed in the end portion on the +X direction side of the inner cover 104. In the recess portion 104*c*, a back surface cover opening/closing detection sensor 120 is disposed. Meanwhile, a detected portion 106*b* (FIG. 33) that protrudes from the path forming surface 106*a* is formed in the end portion on the +X direction side of the back surface cover 106. In the modification form, as an example, when the back surface cover 106 is in a closed state with respect to the inner cover 104, the back surface cover opening/closing detection sensor 120 detects the detected portion 106*b* and detects that the back surface cover 106 is in a closed state.

The liquid storage unit 102 includes: a liquid storage unit main body 103; the inner cover 104 which is attached to be attachable to and detachable from the liquid storage unit main body 103, and forms a part of the first transport path T; and the back surface cover 106 which is configured to be switchable between a closed state and an open state with respect to the inner cover 104, forms the first transport path T together with the inner cover 104 in a closed state, and opens the first transport path T in an open state. The transport section 116 includes: the driving roller 110 provided in the liquid storage unit main body 103; and the driven roller 114 which is held by the back surface cover 106, forms a nipped state with the driving roller 110 in a state where the back surface cover 106 is closed, and releases the nipped state with the driving roller 110 when a closed state and an open state of the back surface cover 106 are switched to each other. In a case where the inner cover 104 together with the back surface cover 106 is detached from the liquid storage unit main body 103, the driven roller 114 is detached together with the back surface cover 106, and the driving roller 110 is held by the liquid storage unit main body 103.

In the modification form, a configuration in which the back surface cover opening/closing detection sensor 120 is provided in the inner cover 104, and is attached to and detached from the liquid storage unit main body 103 together with the inner cover 104 is employed, but, for example, a configuration in which the recess portion 104*c* of the inner cover 104 is an opening and the back surface cover opening/closing detection sensor 120 is attached to the liquid storage unit main body 103 side may be employed.

In the modification form, the number of driving rollers 110 is three, but one or more driving rollers 110 may be provided, and a plurality of rotating shafts 112 may also be provided.

In the modification form, for example, a configuration in which the inner cover 104 is attached and fixed to the liquid storage unit main body 103 by four fastening members (not illustrated) is employed, but as illustrated in FIG. 34, a configuration in which a hook-like hooking section 122*a* is provided in the end portion on the −Z direction side of the inner cover 122 and a hooked portion 124*a* is also provided in the liquid storage unit 124 may be employed. Furthermore, in FIG. 34, a two-dot chain line denoted by reference numeral 122-1 indicates a detachment posture of the inner cover 122.

In the configuration, in the liquid storage unit 124 and the inner cover 122, a configuration in which, after a hooked state (a state indicated by a solid line in FIG. 34) of the hooking section 122*a* and the hooked portion 124*a* is achieved, the inner cover 122 is fixed to the liquid storage unit 124 by one or two fastening members (not illustrated) can be employed.

In the configuration, after one or two fastening members (not illustrated) are loosened and detached from the inner cover 122, when rotating the inner cover 122 to the −Y direction side using the hooking section 122*a* of the inner cover 122 as a fulcrum (arrow A1), it is possible to release the hooked state between the hooking section 122*a* and the hooked portion 124*a*, to pull out the inner cover 122 in the direction of the arrow A2, and to easily detach the inner cover 122 from the liquid storage unit 124. As a result, it is possible to reduce the number of fastening members (not illustrated) for fixing the inner cover 122, to more easily perform access work to the supply connection sections 43*a*, 43*b*, 43*c*, and 43*d* and the pump 56, and to further improve workability of maintenance.

Second Embodiment

Figure 19:
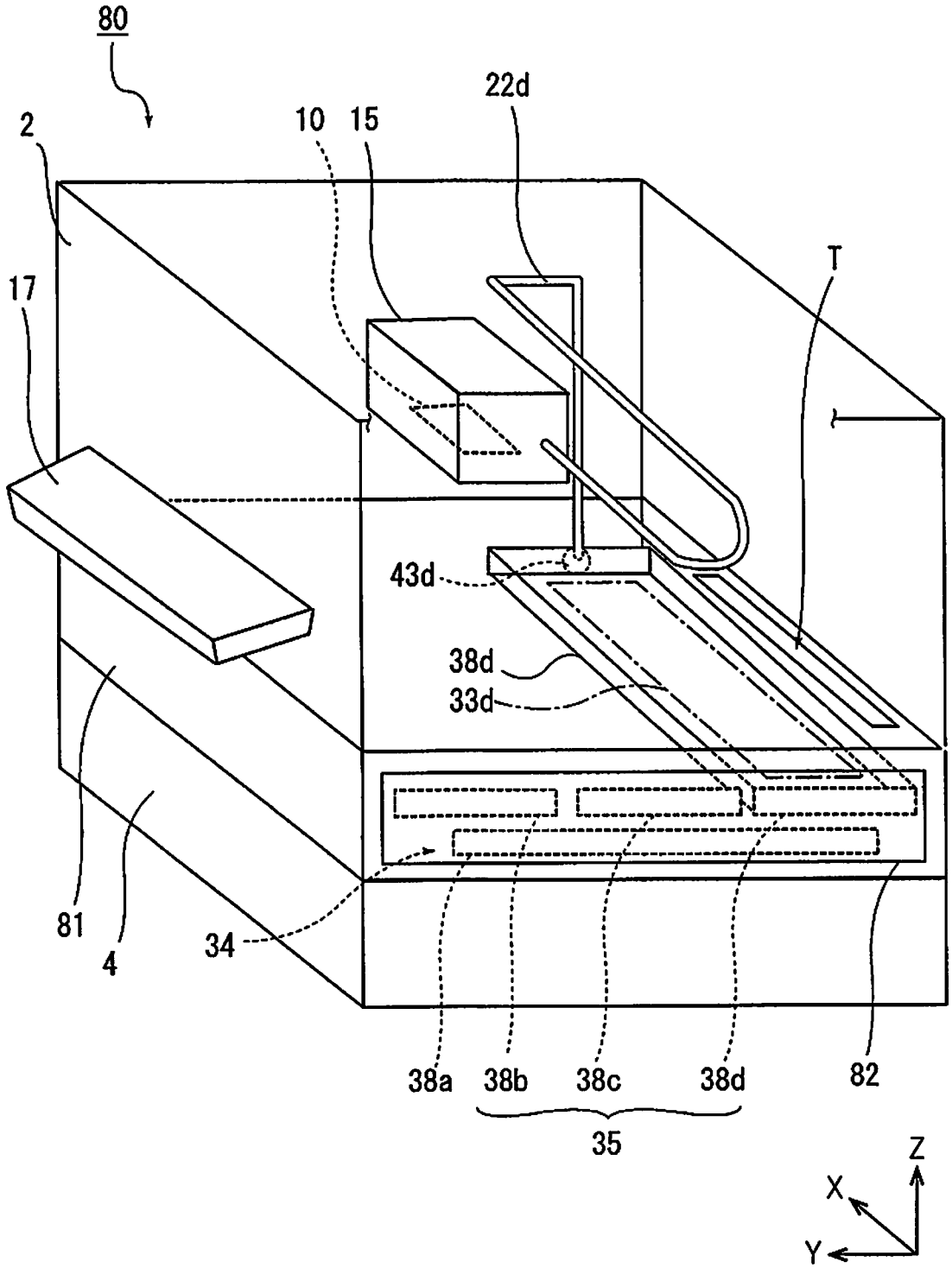
FIG. 19 is a schematic view illustrating a printer according to a second embodiment.

In a second embodiment, another example of the printer will be described with reference to FIG. 19. FIG. 19 is a schematic view illustrating the printer according to the second embodiment.

Furthermore, in the following embodiments including the embodiment, the same reference numerals will be given to the same configurations as those of the first embodiment, and the description thereof will be omitted.

In an ink jet printer 80 (hereinafter, printer 80) of the second embodiment, in a liquid storage unit 81 provided between the recording unit 2 and the medium accommodation unit 4, the drawable tray 38*a* of the first storage section 34 and the drawable trays 38*b*, 38*c*, and 38*d* of the second storage section 35 are configured to be drawable to one side (−X direction) of the apparatus. Reference numeral 82 denotes a cover 82 for opening/closing a surface on the −X direction side of the liquid storage unit 81.

In addition, in the liquid storage unit 81, each of the supply connection sections (only the supply connection section 43*d* with respect to the liquid accommodation body 33*d* is described in FIG. 19) with respect to the plurality of liquid accommodation bodies (only the liquid accommodation body 33*d* stored in the drawable tray 38*d* is described in FIG. 19) stored in the drawable trays 38*a*, 38*b*, 38*c*, and 38*d*, is disposed on the other side (+X direction) of the apparatus.

Furthermore, although not described in FIG. 19, similar to the first embodiment, the liquid accommodation bodies 33*a*, 33*b*, and 33*c* are stored in the drawable trays 38*a*, 38*b*, and 38*c*, and on the other side (+X direction) of the apparatus of the liquid storage units 81, the supply connection sections 43*a*, 43*b*, and 43*c* that correspond to the liquid accommodation bodies 33*a*, 33*b*, and 33*c* are provided.

In addition, in FIG. 19, only the tube 22*d* that serves as the "supply path" for supplying the ink from the liquid accommodation body 33*d* to the recording head 10 is described, but the tubes 22*a*, 22*b*, and 22*c* that correspond to the liquid accommodation bodies 33*a*, 33*b*, and 33*c* are also connected to the recording head 10.

In addition, in the printer 80, the first transport path T provided in the liquid storage unit 81 is provided on the rear side of the apparatus (−Y direction side) with respect to the first storage section 34 (drawable tray 38*a*) and the second storage section 35 (drawable trays 38*b*, 38*c*, and 38*d*). In other words, in the liquid storage unit 81, the first transport path T is disposed in the same manner as in the first embodiment.

In other words, in the printer 80, by drawing out the drawable trays 38*a*, 38*b*, 38*c*, and 38*d* to the side of the apparatus in the −X direction, it is possible to exchange the liquid accommodation bodies 33*a*, 33*b*, 33*c*, and 33*d* stored in the drawable trays 38*a*, 38*b*, 38*c*, and 38*d*.

In addition, since the first transport path T is provided on the rear side of the apparatus (on the −Y direction side) with respect to the first storage section 34 (drawable tray 38*a*) and the second storage section 35 (drawable trays 38*b*, 38*c*, and 38*d*), a configuration in which the first transport path T does not affect the drawing of the drawable trays 38*a*, 38*b*, 38*c*, and 38 can be employed.

Third Embodiment

Figure 20:
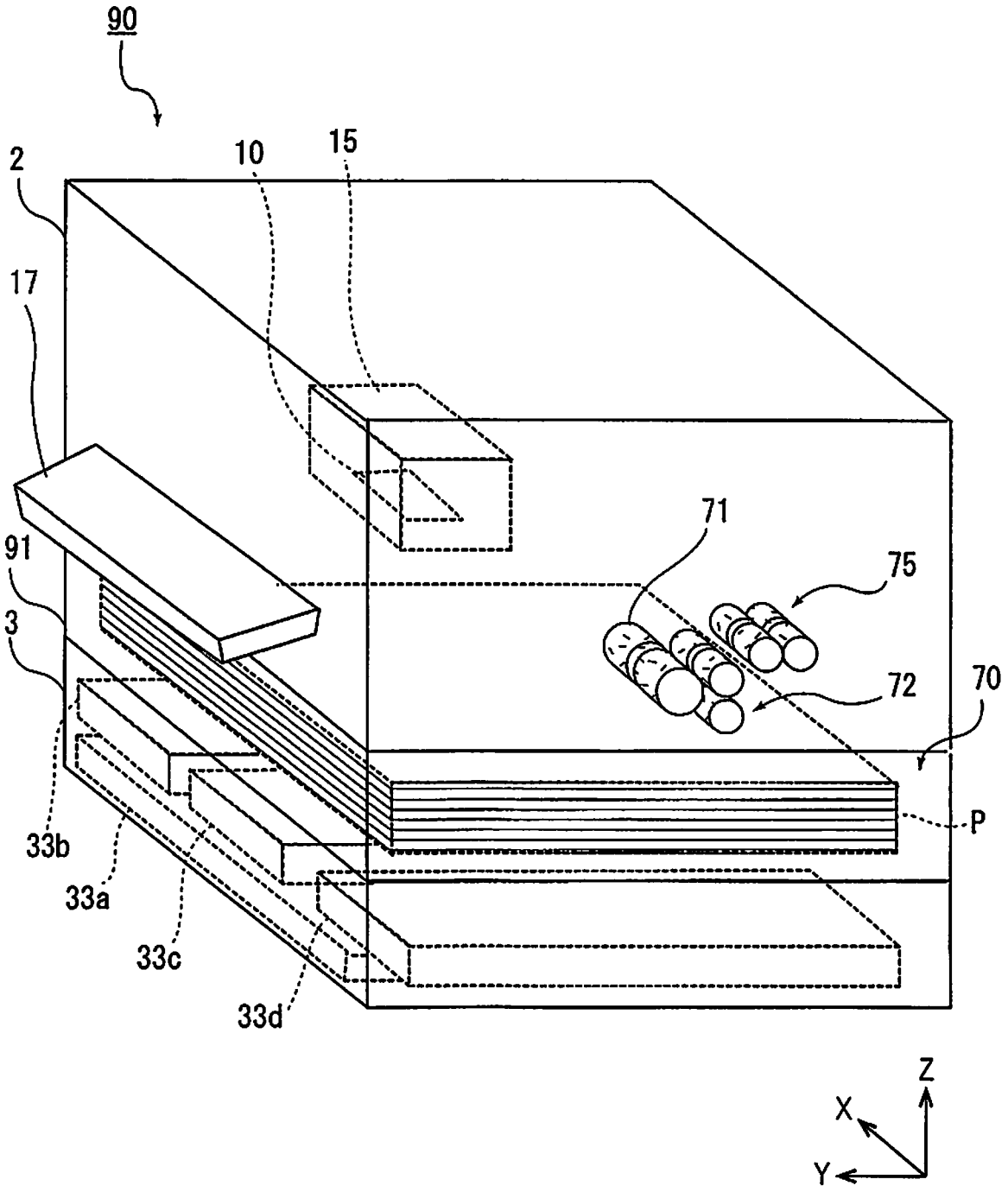
FIG. 20 is a schematic view of a printer according to a third embodiment.
Figure 21:
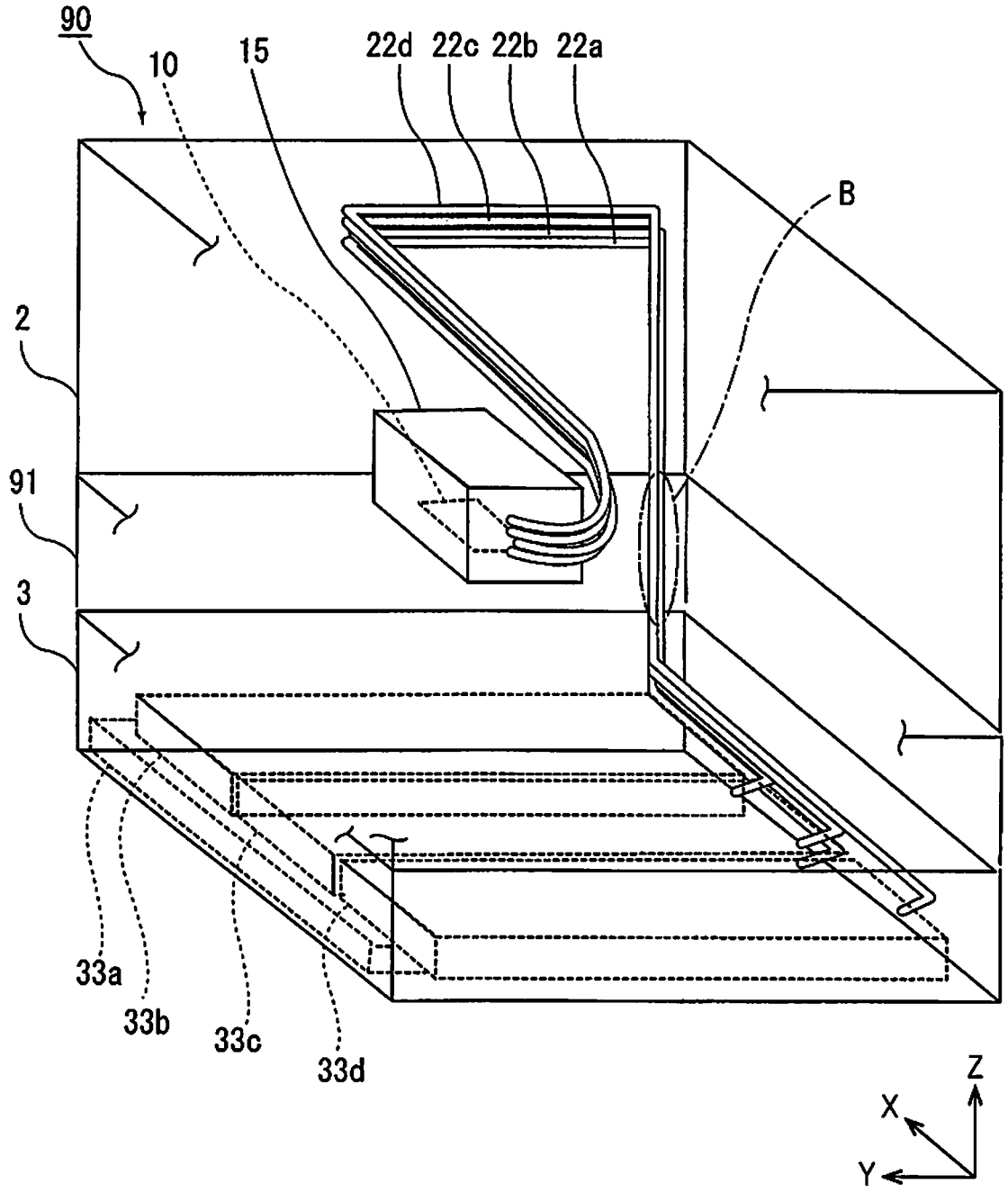
FIG. 21 is a schematic view of the printer according to the third embodiment.
Figure 22:
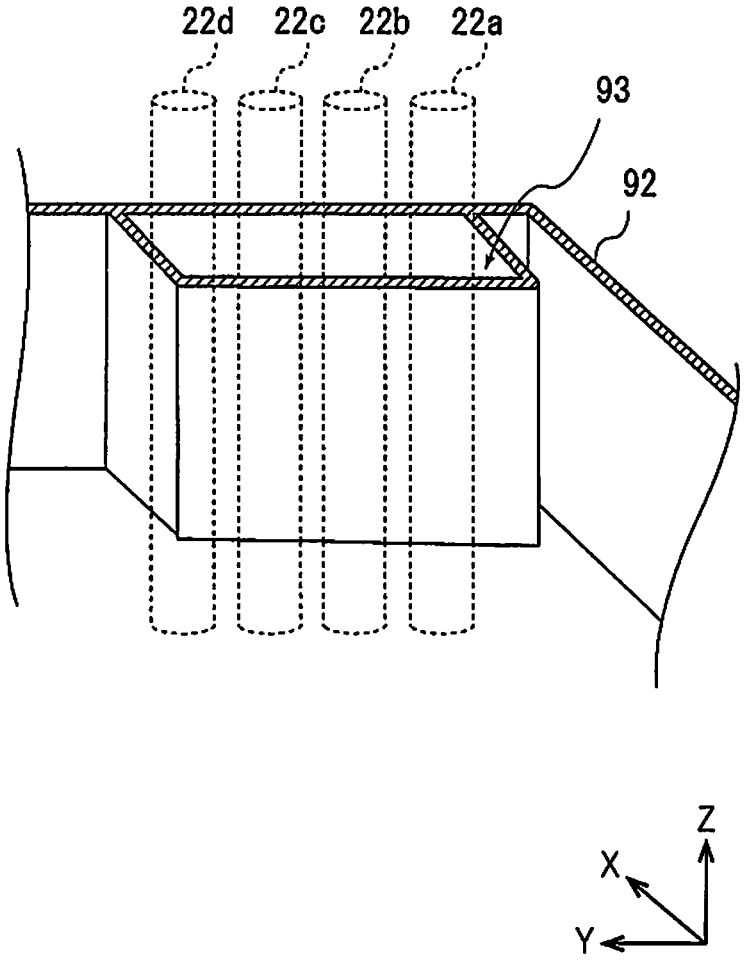
FIG. 22 is a schematic perspective view of a passage section.
Figure 23:
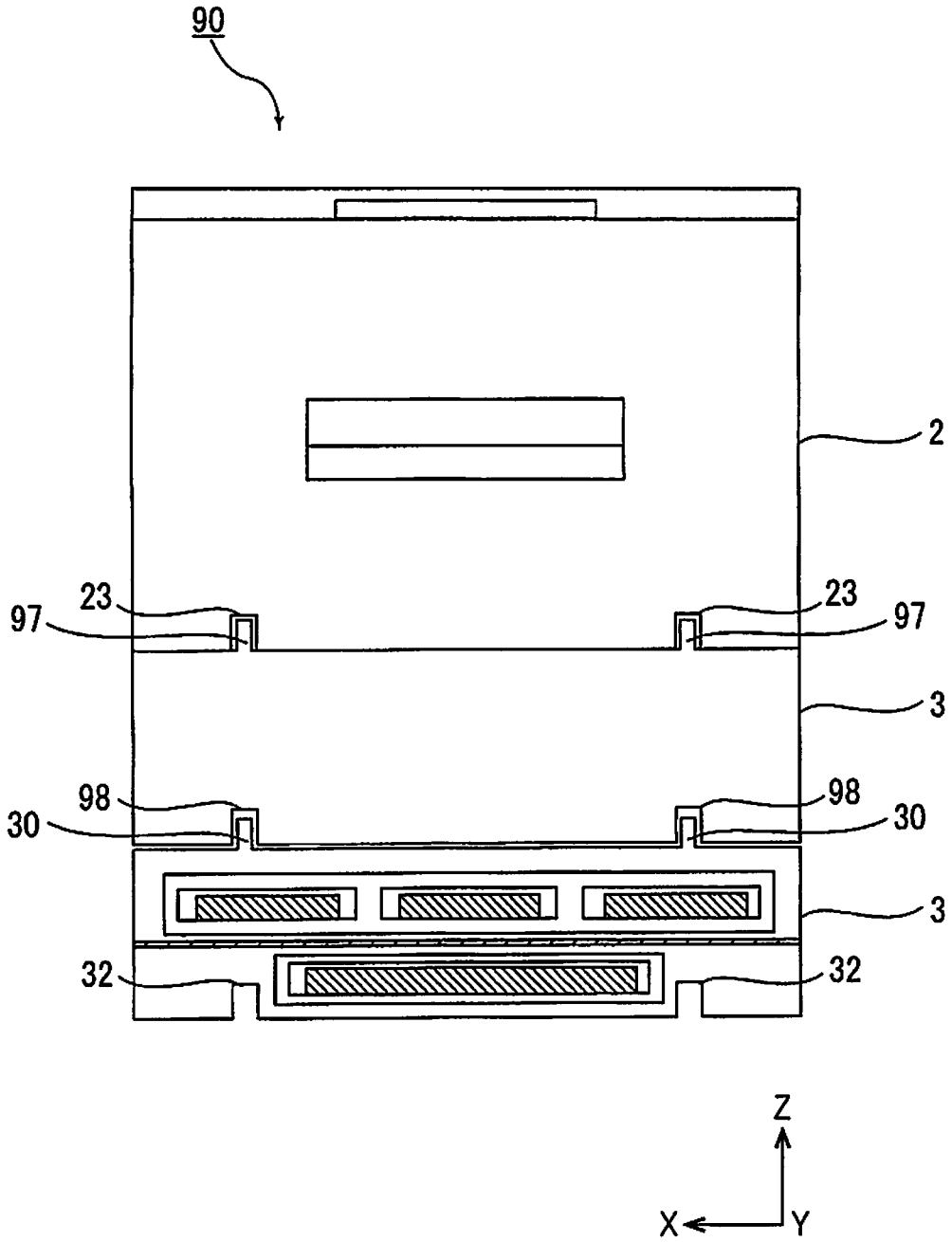
FIG. 23 is a schematic view of the printer according to the third embodiment.
Figure 24:
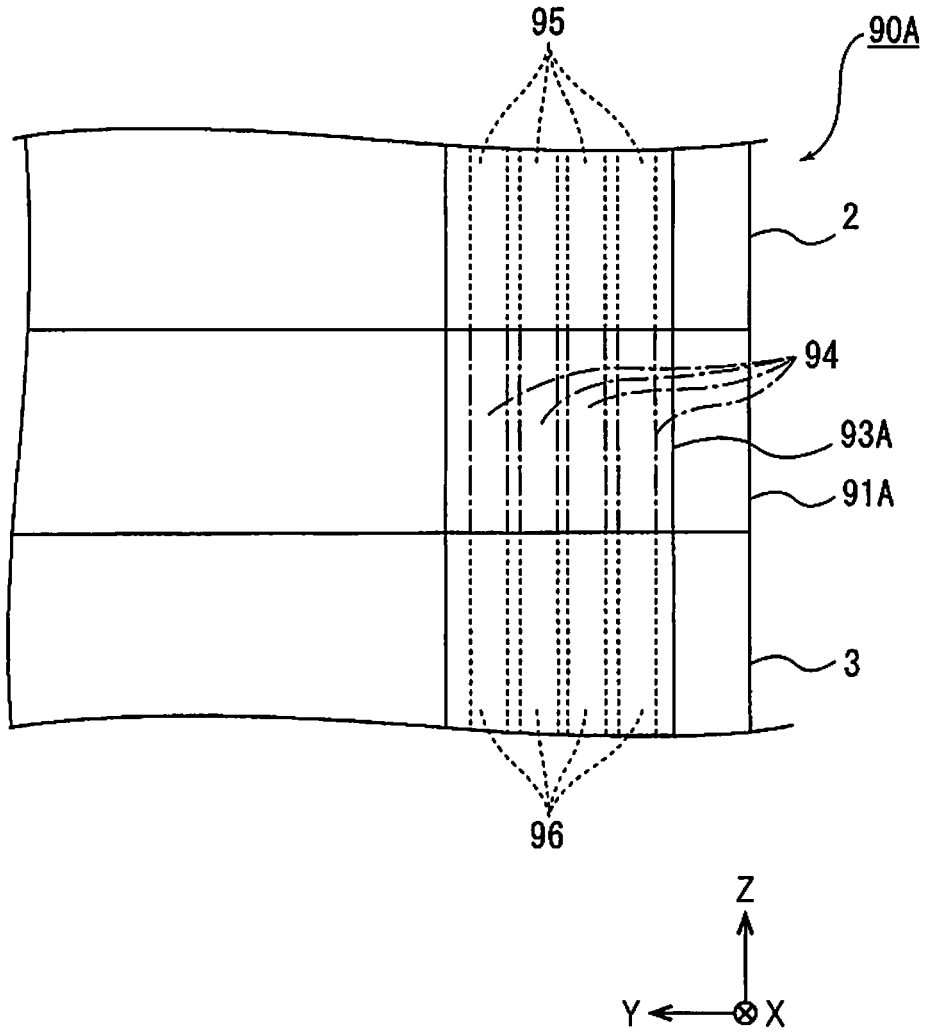
FIG. 24 is a schematic view for describing another example of a supply path.
Figure 25:
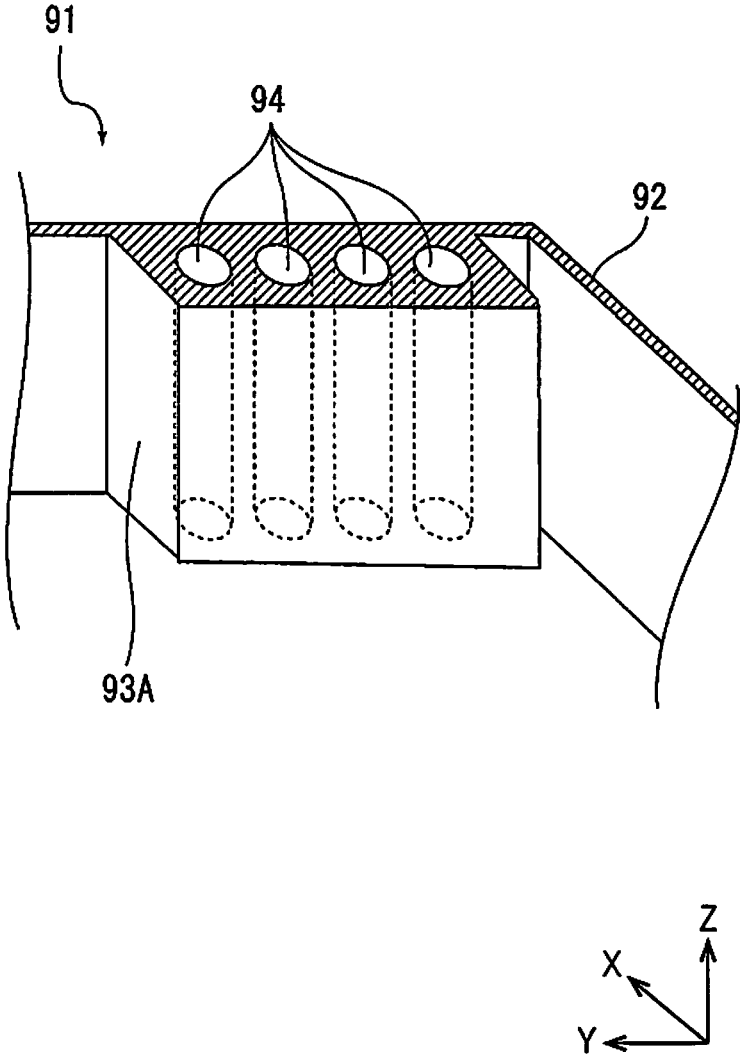
FIG. 25 is a schematic perspective view illustrating another example of the passage section.

In a third embodiment, another example of the printer will be further described with reference to FIGS. 20 to 25. FIG. 20 is a schematic view illustrating the printer according to the third embodiment. FIG. 21 is a schematic view illustrating the printer according to the third embodiment. FIG. 22 is a schematic perspective view of the passage section. FIG. 23 is a schematic view illustrating the printer according to the third embodiment. FIG. 24 is a schematic view for describing another example of the supply path. FIG. 25 is a schematic perspective view illustrating another example of the passage section.

In the third embodiment, in an ink jet printer 90 (hereinafter, referred to as a printer 90) formed by stacking the recording unit 2, the liquid storage unit 3, and a medium accommodation unit 91, the medium accommodation unit 91 is mounted between the recording unit 2 and the liquid storage unit 3.

In other words, the medium accommodation unit 91 can configure the printer 90 by being stacked together with the liquid storage unit 3 which stores the liquid accommodation bodies 33*a*, 33*b*, 33*c*, and 33*d* which accommodate the ink to be supplied to the recording head 10, below the recording unit 2 including the recording head 10 for performing the recording by ejecting the ink onto the paper sheet.

In addition, as illustrated in FIG. 23, the medium accommodation unit 91 includes: a projection portion 97 which is provided above the medium accommodation unit 91 and serves as "upper attachment and detachment section" that is attachable to and detachable from the recess portion 23 provided in the recording unit 2; and a recess portion 98 which is provided below the medium accommodation unit 91 and serves as "lower attachment and detachment section" that is attachable to and detachable from the positioning projection portion 30 provided in the liquid storage unit 3.

As illustrated in FIG. 21, the printer 90 includes a tube (not illustrated) (which can be configured with the same structure as that of the tubes 22*a*, 22*b*, 22*c*, and 22*d* of the first embodiment) that serves as "supply path" for supplying the ink to the recording head 10 from the liquid accommodation bodies 33*a*, 33*b*, 33*c*, and 33*d* which are stored in the liquid storage unit 3, in a state where the recording unit 2, the liquid storage unit 3, and the medium accommodation unit 91 are stacked.

Similar to the medium accommodation unit 4 of the first embodiment, the medium accommodation unit 91 includes the paper sheet tray 70 that serves as "medium accommodation section" for accommodating the paper sheet P.

The configuration for feeding the paper sheet P accommodated in the paper sheet tray 70 can also be the same as the configuration of the medium accommodation unit 4 in the first embodiment. In other words, the paper sheet is fed from the medium accommodation unit 91 by the feeding roller 71, the separation roller pair 72, and the second transport section 75, and the paper sheet is sent through the upstream side transport path S2 and the common transport path S1 provided in the recording unit 2 (respectively refer to FIG. 3, not illustrated in FIG. 20).

Here, in the embodiment, the liquid storage unit 3 is disposed below the medium accommodation unit 91.

Here, the medium accommodation unit 91 includes a passage section 93 (FIG. 22) through which a part of the tubes 22*a*, 22*b*, 22*c*, and 22*d* linked to the recording head 10 from the liquid storage unit 3 passes, at a position surrounded by a one-dot chain line indicated by a reference numeral B of FIG. 21.

In other words, the medium accommodation unit 91 includes: the paper sheet tray 70 which accommodates the paper sheet; a feeding roller 71 which sends the paper sheet to the transport path for transporting the paper sheet to the recording region in which recording is performed by the recording head 10 from the paper sheet tray 70, in a state where the recording unit 2 is mounted in the projection portion 97 and the liquid storage unit 3 is mounted in the recess portion 98; and a passage section 93 through which a part of "supply path" for supplying the ink to the recording head 10 from the liquid accommodation bodies 33*a*, 33*b*, 33*c*, and 33*d* stored in the liquid storage unit 3 can pass.

In the embodiment, the passage section 93 illustrated in FIG. 22 is a space through which the tubes 22*a*, 22*b*, 22*c*, and 22*d* pass. The passage section 93 can be provided integrally with a housing 92 that configures the external appearance of the medium accommodation unit 91, and can also be configured to attach a separate passage section to the housing 92. Further, when a door for opening the passage section 93 to the outside is provided in the housing 92, in a case of additionally installing the medium accommodation unit 91 above the liquid storage unit 3, it is possible to contain each tube 22 within the passage section 93 without changing each tube 22.

By providing the passage section 93 as described above, it is possible to easily realize a configuration of sending the liquid from the liquid storage unit 3 provided below the medium accommodation unit 91 to the recording unit 2 through the medium accommodation unit 91.

In particular, even when the number of medium accommodation units 91 is increased, the "supply path" can be formed, and thus, it is possible to improve expandability of the printer 90.

In addition, the liquid storage unit 3 is positioned below the recording unit 2 and the medium accommodation unit 91. Above, it is possible to obtain a configuration that takes into account both expandability of the printer 90 and appropriate disposition of the liquid storage unit 3.

Further, in the printer 90, since the medium accommodation unit 91 is provided above the liquid storage unit 3, the transport distance from the medium accommodation unit 91 to the recording head 10 is reduced to be shorter than that in a case of feeding the paper sheet from the medium accommodation unit 4 in the printer 1 of the first embodiment, and the throughput of the recording is improved.

In addition, in a case where the liquid storage unit 3 is provided below the medium accommodation unit 91, since it is not necessary to transport the medium in the liquid storage unit 3, it is possible to omit the first transport path T including the first transport section 55 of the first embodiment.

Other Configuration of Passage Section

In addition to a case where the "supply path" of the ink is formed by a tube, for example, in a case where the recording unit 2, the medium accommodation unit 91, and the liquid storage unit 3 are stacked and mounted, a configuration in which the partial supply paths provided in each unit are connected, and one "supply path" is formed can be employed.

As illustrated in FIG. 24, there is provided a printer 90A which is a modification example of the embodiment including: a first supply path 95 that serves as "supply path" provided on the recording unit 2 side; and a second supply path 96 that serves as "supply path" provided on the liquid storage unit 3 side, in which a medium accommodation unit 91A has a relay path 94 (also refer to FIG. 25) which is "supply path" for relaying the first supply path 95 and the second supply path 96, as a passage section 93A.

By the medium accommodation unit 91A having the above-described configuration, it is possible to easily realize a configuration of sending the liquid from the liquid storage unit 3 to the recording unit 2 via the medium accommodation unit 91A.

Furthermore, the disclosure is not limited to the embodiments described above, and various modifications are possible within the range of the disclosure described in the range of the claims, and it is needless to say that the modifications are included within the range of the disclosure.

What is claimed is:

1. A recording apparatus, comprising:

a recording unit including a recording section which performs recording on a medium;

a liquid storage unit storing a plurality of liquid accommodation bodies each of which accommodates a liquid to be supplied to the recording section therein; and at least one medium accommodation unit accommodating the medium to be sent to the recording section therein, wherein, in a state where at least one medium accommodation unit, the liquid storage unit, and the recording unit are stacked in an order of the at least one medium accommodation unit, the liquid storage unit, and the recording unit, a supply path for supplying the liquid from the liquid accommodation bodies stored in the liquid storage unit to the recording section and a transport path for transporting the medium from the medium accommodation unit to a recording region in which recording is performed by the recording section are configured, and wherein the liquid storage unit includes a plurality of supply connection sections each of which connects the liquid accommodation body and the supply path to each other, and a liquid storage unit inner transport path which forms a part of the transport path and includes a pair of rollers that transports the medium, a first storage section which stores one of the liquid accommodation bodies therein, and a second storage section which is provided above the first storage section and stores the remaining liquid accommodation bodies, and a plurality of pumps each of which is configured to pressurize the supply connection section and is provided beside the first storage section.

2. The recording apparatus according to claim 1, wherein the liquid storage unit includes a power transmission section which transmits power of a second transport section that is provided in the medium accommodation unit mounted below the liquid storage unit and transports the medium, to the pair of rollers.

3. The recording apparatus according to claim 1, wherein the first storage section and the second storage section are configured to be drawable to the front of the apparatus, and wherein each of the supply connection sections for the plurality of the liquid accommodation bodies is disposed on a rear side of the apparatus.

4. The recording apparatus according to claim 3, wherein the liquid storage unit inner transport path is provided on the rear side of the apparatus with respect to the supply connection section.

5. The recording apparatus according to claim 1, wherein the first storage section and the second storage section are configured to be drawable to one side of the apparatus, and wherein each of the supply connection sections for the plurality of the liquid accommodation bodies is disposed on the other side of the apparatus.

6. The recording apparatus according to claim 5, wherein the liquid storage unit inner transport path is provided on the rear side of the apparatus with respect to the first storage section and the second storage section.

7. The recording apparatus according to claim 3, wherein a width of the first storage section is narrower than a width of the second storage section in a direction intersecting with a drawing-out direction of the first storage section and the second storage section.

8. The recording apparatus according to claim 1, wherein at least a part of an upper portion of the liquid storage unit is formed of sheet metal.

9. The recording apparatus according to claim 8, wherein the liquid storage unit includes a first attachment and detachment section which is provided on an upper side thereof and is attachable to and detachable from any one of the recording unit or the medium accommodation unit, and a second attachment and detachment section which is provided on a lower side thereof and is attachable to and detachable from the medium accommodation unit, wherein the first attachment and detachment section is a positioning projection portion which is formed above the sheet metal and is inserted into a recess portion provided in a bottom portion of the recording unit or the medium accommodation unit, and wherein the second attachment and detachment section is a positioning recess portion which is an opening formed in the bottom portion of the liquid storage unit and which receives the projection portion provided above the medium accommodation unit.

10. The recording apparatus according to claim 1, wherein the recording unit includes a built-in medium accommodation section which is built in the recording unit and accommodates the medium to be sent to the recording section.

11. The recording apparatus according to claim 1, wherein the liquid storage unit includes a liquid storage unit main body, an inner member which is detachably attached to the liquid storage unit main body and forms a part of the liquid storage unit inner transport path, and an outer member which is configured to be capable of switching between a closed state and an open state with respect to the inner member, forms the liquid storage unit inner transport path together with the inner member in the closed state, and opens the liquid storage unit inner transport path in the open state, wherein the pair of rollers includes a driving roller provided in the liquid storage unit main body, and a driven roller which is held by the outer member, forms a nipped state with the driving roller in the closed state of the outer member, and releases the nipped state with the driving roller when switching from the closed state to the open state of the outer member, and wherein the driven roller is detached together with the outer member from the liquid storage unit main body and the driving roller is held by the liquid storage unit main body in a case where the inner member is detached together with the outer member from the liquid storage unit main body.

* * * * *